US012357088B2

(12) United States Patent
Boekhoff et al.

(10) Patent No.: US 12,357,088 B2
(45) Date of Patent: Jul. 15, 2025

(54) FURNITURE ELEMENT AND PIECE OF FURNITURE

(71) Applicant: Paul Hettich GmbH & Co. KG, Kirchlengern (DE)

(72) Inventors: Heiko Boekhoff, Bad Oeynhausen (DE); Britta Kloss, Bielefeld (DE); Waldemar Petker, Bünde (DE); Timo Szlapka, Bielefeld (DE); Sören Klüter, Bad Oeynhausen (DE); Timo Kaps, Werther (DE); Verena Düllmann, Bielefeld (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 124 days.

(21) Appl. No.: 18/273,815

(22) PCT Filed: Jan. 21, 2022

(86) PCT No.: PCT/EP2022/051321

§ 371 (c)(1),
(2) Date: Jul. 24, 2023

(87) PCT Pub. No.: WO2022/157295

PCT Pub. Date: Jul. 28, 2022

(65) Prior Publication Data

US 2024/0115040 A1 Apr. 11, 2024

(30) Foreign Application Priority Data

Jan. 25, 2021 (DE) ..... 10 2021 101 536.7
Apr. 22, 2021 (DE) ..... 10 2021 110 323.1

(51) Int. Cl.
*A47B 49/00* (2006.01)
*A47B 81/00* (2006.01)

(52) U.S. Cl.
CPC ..... *A47B 49/006* (2013.01); *A47B 81/002* (2013.01)

(58) Field of Classification Search
CPC ..... A47B 49/004; A47B 49/006; A47B 46/00; A47B 81/002
See application file for complete search history.

(56) References Cited

U.S. PATENT DOCUMENTS 4,124,262 A * 11/1978 Schill ..... A47B 49/004 312/307
5,207,781 A * 5/1993 Rock ..... A47B 88/467 312/319.1

(Continued)

FOREIGN PATENT DOCUMENTS

DE 10119159 C1 * 8/2002 ..... A47B 49/006
DE 10 2011 053 840 A1 3/2013

(Continued)

OTHER PUBLICATIONS

International Search Report in PCT/EP2022/051321, mailed Apr. 28, 2022.

*Primary Examiner* — Andrew Roersma
(74) *Attorney, Agent, or Firm* — Collard & Roe, P.C.

(57) ABSTRACT

A furniture element, in particular a support or shelf having at least one storage level, has a carcass having at least one support surface, and a translational-rotation fitting for allowing a translational-rotational movement of the carcass relative to a carrier plate of the fitting from a starting position into an open position, and back. The carcass can be moved, relative to the carrier plate, out of a starting position, into an intermediate position, and further into an open position, and back. In an intermediate position, the carcass is rotated in a rotational direction and is displaced in a predefined direction; a guide channel that specifies the direction is provided in the carrier plate, in which guide channel a guide carriage (Continued)

is displaceably received. There is at least one self-retraction apparatus coupled to the guide carriage and is situated on a side of the carrier plate facing away from the carcass.

16 Claims, 26 Drawing Sheets

(56) References Cited

U.S. PATENT DOCUMENTS

| | | | | |
|---|---|---|---|---|
| 8,020,951 | B2 * | 9/2011 | Twellmann | A47B 81/002 312/238 |
| 11,085,223 | B2 | 8/2021 | Oestermann et al. | |
| 2018/0049545 | A1 * | 2/2018 | Sagel | A47B 81/002 |
| 2020/0018349 | A1 * | 1/2020 | Rehage | A47B 77/10 |
| 2022/0211176 | A1 | 7/2022 | Rehage et al. | |
| 2022/0225763 | A1 | 7/2022 | Rehage et al. | |

FOREIGN PATENT DOCUMENTS

| | | | | |
|---|---|---|---|---|
| DE | 10 2009 025 785 | B4 | 8/2017 | |
| DE | 102018108978 | A1 * | 3/2019 | A47B 49/004 |
| DE | 102018209659 | A1 * | 12/2019 | |
| DE | 10 2019 109 866 | A1 | 10/2020 | |
| EP | 1925237 | A2 * | 5/2008 | A47B 81/002 |
| EP | 1932446 | A2 * | 6/2008 | A47B 49/006 |
| EP | 2 153 003 | B1 | 2/2014 | |
| EP | 2654505 | B1 | 2/2015 | |
| EP | 2 272 400 | B1 | 2/2019 | |
| EP | 3 532 689 | B1 | 7/2020 | |
| WO | WO-2019042922 | A1 * | 3/2019 | A47B 49/004 |
| WO | WO-2020007525 | A1 * | 1/2020 | A47B 49/004 |
| WO | 2020/233911 | A1 | 11/2020 | |

* cited by examiner

FURNITURE ELEMENT AND PIECE OF FURNITURE

CROSS REFERENCE TO RELATED APPLICATIONS

This application is the National Stage of PCT/EP2022/051321 filed on Jan. 21, 2022, which claims priority under 35 U.S.C. § 119 of German Application No. 10 2021 101 536.7 filed on Jan. 25, 2021 and German Application No. 10 2021 110 323.1 filed on Apr. 22, 2021, the disclosures of which are incorporated by reference. The international application under PCT article 21(2) was not published in English.

The present invention relates to a furniture element, in particular a support or shelf according to the preamble of claim 1, and to a piece of furniture comprising such a furniture element.

Such furniture elements are usually used as individual pieces of furniture, for example in the form of a shelf or a support, or as a partial element of a piece of furniture comprising several furniture elements, which, placed on a floor of a room, a table or the like, can be rotated about a vertical axis and at the same time moved in a predetermined direction.

This makes it easy to move the furniture element out of a corner of the room or furniture with two side walls aligned at an angle to each other.

To enable such a movement, the furniture element, for example known from DE 10 2019 109 866 A1, has at least one translational-rotational fitting in addition to two side walls closing the interior or storage space in a starting position.

Such furniture element has actually proven itself in practice.

It is the object of the present invention to further develop a furniture element in such a way that the end positions of the furniture element, i.e. the closed position and the open position, are reached in a simple manner.

This object is solved by a furniture element as well as a piece of furniture as described below.

The furniture element according to the invention has a carcass having at least one support surface and at least one translational-rotational fitting, which enables a translational-rotational movement of the carcass relative to a carrier plate of the translational-rotational fitting from a starting position to an open position and back.

The carcass is movable relative to the carrier plate from a starting position into an intermediate position and further into an open position and back, wherein in an intermediate position the carcass is rotated relative to the carrier plate in a direction of rotation and displaced in a predetermined direction.

A guide channel is provided in the carrier plate, which determines the direction and in which a guide carriage is displaceably accommodated.

The furniture element further has at least one self-retraction apparatus which is coupled at least in sections to the guide carriage and arranged directly or indirectly on a side of the carrier plate—at the top or bottom—facing away from the carcass.

Coupling the guide carriage to such a self-retraction apparatus makes it possible to reach the respective end positions of the initial position and the open position in a simple manner.

It can be advantageous, particularly for taller furniture elements, if such a translational-rotational fitting is present in the upper region and in the lower region in each case, wherein at least one of the translational-rotational fittings is equipped with a self-retraction apparatus.

Advantageous embodiment variants of the invention are the subject matter of the subclaims.

In an advantageous embodiment variant, the self-retraction apparatus is attached directly to the side of the carrier plate facing away from the carcass.

According to an advantageous further development, a coupling element having at least one first activator for activating the self-retraction apparatus is arranged on the guide carriage.

The coupling element is preferably designed as a bracket integrally formed on or attached to the guide carriage, with the at least one first activator protruding from a web of the coupling element that projects laterally beyond the guide carriage.

According to a preferred embodiment variant, a self-retraction apparatus coupled to the guide carriage is arranged on either side of the carrier plate facing away from the carcass.

This enables uniform power transmission from the self-retraction apparatus to the guide carriage.

According to an alternative embodiment variant, the guide carriage is coupled to a running rail of at least one pull-out guide, wherein a guide rail of the pull-out guide is fastened to the side of the carrier plate facing away from the carcass, wherein the at least one self-retraction apparatus is arranged on the guide rail of the pull-out guide.

In a preferred further development of this embodiment variant, the at least one pull-out guide is coupled via a coupling element integrally formed on or attached to the guide carriage.

According to a further embodiment variant, the furniture element is further characterized by at least one opening mechanism coupled to the guide carriage and arranged on a side of the carrier plate facing away from the carcass for opening the carcass.

This opening mechanism is preferably designed as an ejector or push-to-move mechanism and, in particular, allows the furniture element to be designed without an actuating handle and to initiate the opening movement of the furniture element by pushing in against the intended opening direction. An ejector mechanism with a mechanical force storage device and a clamping device supplied with energy from an electrical energy storage device can also be used. A corresponding ejection mechanism is described, for example, in EP 3532689 B1. A purely electrical ejection mechanism, for example according to DE 102009025785 B4 or EP 2153003 B1, can also be used.

It is also conceivable to use an opening mechanism that can be activated in another way.

The opening mechanism can also be used to initiate the movement of the furniture element from the open position back to the starting position.

According to a preferred embodiment variant, a coupling element separate from the guide carriage with at least a second activator is used to activate the opening mechanism.

In an alternative preferred embodiment variant, at least one second activator for activating the opening mechanism is arranged on the coupling element with the at least one first activator for activating the self-retraction apparatus.

This makes it possible to operate both the self-retraction apparatus and the opening mechanism by means of a single coupling element, which reduces the assembly effort.

The at least one second activator preferably protrudes from the web of the coupling element projecting laterally beyond the guide carriage.

Furthermore, according to a preferred embodiment variant, an opening mechanism coupled to the guide carriage is arranged in each case on either side of the carrier plate facing away from the carcass.

The self-retraction apparatus is preferably arranged between the guide channel and the opening mechanism, as viewed perpendicularly to the longitudinal extension of the guide channel.

According to a further preferred embodiment variant, the opening mechanism is arranged on the at least one pull-out guide.

According to a further alternative embodiment, at least one opening mechanism for opening the carcass is arranged at a distance from the guide channel in or on the carrier plate.

In this embodiment variant, there is no coupling of the at least one opening mechanism to the guide carriage. For activation, a surface of the carcass or the bearing plate of the translational-rotational fitting or an activator arranged on the carcass or the bearing plate is brought into engagement with the opening mechanism.

In one embodiment variant, the opening mechanism can be designed as a mechanical opening mechanism with a plunger which is spring-mounted in a housing or, according to an alternative embodiment, as an electromotively driven opening mechanism having a plunger mounted in a housing and driven by an electric motor.

According to a further embodiment variant, the at least one self-retraction apparatus has a toggle lever with a pendulum lever pivotably attached to the guide carriage and a power lever pivotably coupled to the pendulum lever and pivotably attached to the carrier plate, wherein at least one energy storage device held on the carrier plate is arranged on the power lever or the pendulum lever.

In a preferred embodiment variant, the self-retraction apparatus has a damper so that the furniture element is braked before reaching the respective end position, i.e. the starting position and the open position.

The furniture according to the invention is characterized by a furniture element as described above.

Preferred embodiment variants are explained in more detail below with reference to the accompanying figures, wherein:

FIG. 1 shows an isometric representation of an embodiment variant of a furniture element according to the invention in the closed starting position, FIG. 2 shows an isometric representation of the furniture element shown in FIG. 1 in partially opened intermediate position, FIG. 3 shows a representation of the furniture element in the open position corresponding to FIG. 1, FIG. 4 shows an isometric exploded view of the translational bearing of the furniture element and the guide carriage arranged on it as well as self-retraction apparatuses and opening mechanisms to be arranged on the carrier plate, FIG. 5 shows an isometric detailed view of an embodiment variant of a coupling element for coupling the guide carriage to the self-retraction apparatus and the opening mechanism, FIG. 6 shows an isometric view of the guide carriage arranged on the carrier plate of the translational-rotational fitting and two self-retraction apparatuses and opening mechanisms, FIG. 7 shows a view from below of the carrier plate with guide carriage arranged thereon, self-retraction apparatus and opening mechanisms in the closed starting position of the furniture element, FIG. 8 shows a representation corresponding to FIG. 7 in the partial open position according to FIG. 2, FIG. 9 shows an isometric exploded view of an alternative embodiment variant with a guide carriage arranged on the translational-rotational fitting and pull-out guides with a self-retraction apparatus arranged thereon, FIG. 10 shows a view from below, corresponding to FIG. 7, of the carrier plate with pull-out guides according to FIG. 9 in the closed starting position of the furniture element, FIG. 11 shows a representation corresponding to FIG. 10 with the running rails extended, FIG. 12 shows an isometric exploded view of the translational bearing of the furniture element and the guide carriage arranged thereon, as well as self-retraction apparatuses to be arranged on the carrier plate and an alternative opening mechanism, FIG. 13 shows a view from below of the carrier plate with guide carriage arranged thereon, self-retraction apparatus and the alternative opening mechanism from FIG. 12 in the closed starting position of the furniture element, FIG. 14 shows an isometric exploded view of a further alternative design variant with opening mechanisms to be arranged in an edge region of the carrier plate, FIG. 15 shows an isometric view of the structure according to FIG. 14 in the assembled state, FIG. 16 shows an isometric exploded view of another alternative embodiment variant with an electromotively driven opening mechanism to be arranged in an edge region of the carrier plate, FIG. 17 shows an isometric representation of the structure according to FIG. 16 in the assembled state, FIG. 18 shows an isometric view of the structure shown in FIG. 16 in the state mounted on the carcass before the opening mechanism is triggered, FIG. 19 shows an isometric view of the structure shown in FIG. 16 in the state mounted on the carcass after the opening mechanism has been triggered, FIG. 20 shows an isometric exploded view of another alternative embodiment variant with first activators integrally formed on the guide carriage for triggering the self-retraction apparatuses, FIG. 21 shows an isometric representation of the structure according to FIG. 20 in the assembled state before the self-retraction apparatus is triggered, FIG. 22 shows an isometric detailed view of the area marked XXII in FIG. 21 to show a first activator before the self-retraction apparatus is pre-tensioned, FIG. 23 shows a representation corresponding to FIG. 21 after pretensioning the self-retraction apparatus, FIG. 24 shows an isometric detailed view of the area marked XXIV in FIG. 23 to show a first activator after pretensioning the self-retraction apparatus, FIG. 25 shows a representation corresponding to FIG. 21 when the self-retraction apparatus is triggered, FIG. 26 shows an isometric detailed view of the area marked XXVI in FIG. 25 to show a first activator when the self-retraction apparatus is triggered, FIG. 27 shows an isometric exploded view of a further alternative embodiment variant with a self-retraction apparatus in the form of a toggle lever that engages the guide carriage, FIG. 28 shows an isometric exploded view of the components of the self-retraction apparatus designed as a toggle lever, FIG. 29 shows a top view of the structure according to FIG. 27 in the assembled state with the carcass rotated by about 25°, FIG. 30 shows a representation corresponding to FIG. 29 with the carcass rotated by about 45°, FIG. 31 shows a representation corresponding to FIG. 29 in the closed position of the carcass, and FIG. 32 shows a representation corresponding to FIG. 29 in the fully open position of the carcass.

In the following description of figures, terms such as top, bottom, left, right, front, rear, etc. refer exclusively to the exemplary representation and position of the furniture element, translational-rotational fitting, guide carriage, self-retraction apparatus, carrier plate and the like selected in the respective figures. These terms are not to be understood restrictively, i.e., different working positions or the mirror-symmetrical design or the like can change these references.

In FIGS. 1 to 3, the reference sign 1 generally designates a variant of a furniture element according to the invention. The furniture element 1 can be designed as a stand-alone furniture element 1 or also as part of a piece of furniture with a carcass having further furniture elements, from which the furniture element 1 can be moved in a translational-rotational movement from a starting position shown in FIG. 1, in which an interior space 23 shown in FIGS. 2 and 3 is concealed by side walls 21, 22, into an open position shown in FIG. 3, in which the interior space 23 is accessible for the insertion or removal of objects from the interior space 23.

The furniture element 1 has a carcass 2 with side walls 21,22 and an interior space 23 defined by a frame 25. The furniture element 1 further has at least one support surface 24, which in the shown exemplary embodiment forms a base of the interior space 23.

Below the base, the carcass 2 is placed on feet 11. These feet 11 are attached to a side of a carrier plate 32 of a translational-rotational fitting 3 arranged below the support surface 24 and facing away from the support surface 24.

An exemplary embodiment of such a translational-rotational fitting 3 is shown in an exploded view in FIG. 4.

The translational-rotational fitting 3 serves to enable a translational-rotational movement of the carcass 2 relative to the carrier plate 32 of the translational-rotational fitting 3 from the starting position shown in FIG. 1, through an intermediate position shown in FIG. 2, to an open position shown in FIG. 3, and back.

To enable the carcass 2 of the furniture element 1 to be rotated out of a space or furniture corner, the translational-rotational fitting 3 is configured such that the carcass 2 is rotated relative to the carrier plate 32 in a rotational direction R1 and displaced in a predetermined direction in the intermediate position shown in FIG. 2.

To enable guided displacement, a guide channel 323 is provided in the carrier plate 32, as shown, for example, in FIGS. 4 and 6 to 13. In this guide channel 323, a guide carriage 4, which is fixed to a bearing plate 31 of the translational-rotational fitting 3 in a receptacle 311 provided for this purpose, is accommodated so as to be displaceable in the predetermined direction A.

The guide carriage 4 has a base body 41 with preferably a plurality of wheels 42 attached to the side of the base body 41.

A guide pin 43 protrudes centrally from the base body 41, the free end of which is rotatably fixed in the receptacle 311 of the bearing plate 31 of the translational-rotational fitting 3.

In this case, the bearing plate 31 is attached to the carcass 2, in the shown exemplary embodiment to the underside of the support surface 24 of the carcass 2 of the furniture element 1.

The guided rotational movement of the bearing plate 31 relative to the carrier plate 32 of the translational-rotational fitting 3 is made possible by running grooves 12, in which rolling elements 10 mounted in a rolling element cage 33 are guided. Further running grooves (not shown) are provided in the side of the bearing plate 31 facing the carrier plate 32.

As further shown in FIGS. 4 to 13, at least one self-retraction apparatus 5 coupled to the guide carriage 4 and arranged on a side 322 of the carrier plate 32 facing away from the carcass 2 is provided on the side of the carrier plate 32 facing away from the bearing plate 31.

In a first exemplary embodiment shown in FIGS. 4 to 8, one such self-retraction apparatus 5 is attached directly to the side of the carrier plate 32 facing away from the bearing plate 31 on both sides of the guide channel 323.

A coupling element 7 provided with two first activators 71 on the guide carriage 4 is used to activate the two self-retraction apparatuses 5.

A detailed illustration of the coupling element 7 is shown in FIG. 5. The coupling element 7 is designed here as a bracket that can be attached to the guide carriage 4.

The first two activators 71 project from a web 74 of the coupling element 7, which projects laterally beyond the guide carriage 4.

It is also conceivable to arrange only one such self-retraction apparatus 5 on the carrier plate 32.

The self-retraction apparatus 5 itself serves to move the carcass 2 of the furniture element 1 during movement into an end position, in the present case on the one hand into the closed starting position shown in FIG. 1 and on the other hand into the open position shown in FIG. 3.

The design and function of such a self-retraction apparatus 5 is known from the prior art, for example from DE 10 2011 053 840 A1, so that a more detailed explanation of the design and function of the self-retraction apparatus 5 can be dispensed with here. The self-retraction apparatus 5 can also have a damping element to ensure gentle retraction into the end position.

By means of the coupling element 7 with the first activators 71, the self-retraction apparatus 5 is activated in each case shortly before reaching the starting position or the open position and moves the guide carriage 4 coupled via the first activators 71 of the coupling element 7 and with it the bearing plate 31 and thus the carcass 2 of the furniture element 1 into the starting position or open position.

As shown in FIGS. 4 and 6 to 8, on the sides of the respective self-retraction apparatus 5 facing away from the guide channel 323, an opening mechanism 6 is additionally arranged in each case on a side 322 of carrier plate 32 facing away from the body 2.

The opening mechanism 6 is also coupled to the guide carriage 4 via the coupling element 7. For this purpose, as shown in FIG. 5, the coupling element 7 has respective second activators 72 in the area of the webs 74, which project from the respective web 74.

It is also conceivable to provide a separate coupling element on the guide carriage 4 with a respective activator for activating the opening mechanism 6.

The opening mechanism 6 is preferably designed as a push-to-open mechanism. This enables the opening mechanism 6 to be triggered by briefly pressing against the side wall 21 of the carcass 2 and to move the carcass 2 from the starting position or the open position against the pressing direction. For this purpose, the carcass 2 can be rotated from the starting position against the opening direction by a small amount, preferably a few degrees, in particular by 1° to 2° relative to the carrier plate. The same applies to activating the closing movement from the open position.

In doing so, the opening mechanism 6 pushes the guide carriage 4 coupled to it along the guide channel 323, thereby initiating the translational-rotational movement of the bearing plate 31 and thus of the carcass 2 of the furniture element 1 relative to the carrier plate 32.

The structure and function of such an opening mechanism is known, for example, from WO 2020/233911 A1, EP2272400 B1 or EP2654505B1, to which reference is hereby made.

As shown in FIG. 5, the second activator 72 is preferably formed as a tongue vertically bent over from the web 74.

As further shown in FIG. 6, a carriage track 324 is preferably formed in the surface of the second side 322 of the carrier plate 32 for guiding the guide carriage 4.

The carriage track 324, which is formed here as a recess, serves in particular to keep the vertical structure of the components below the carrier plate 32 as small as possible.

FIG. 7 shows the furniture element 1 from below in the closed position of the furniture element 1 shown in FIG. 1. The opening mechanism 6 is activated by slightly pressing the side wall 21 in the area marked P towards the inside of the carcass.

FIG. 8 shows the furniture element 1 from below in the partially opened position shown in FIG. 2. As can be clearly seen here, the guide carriage 4 is out of engagement with the opening mechanism 6 and the self-retraction apparatus 5 in this position, in which the carcass 2 is rotated by about 45° relative to the carrier plate 32, and can thus be moved further in the opening direction R1 or closing direction R2 by an operator alone.

FIGS. 9 to 11 show an alternative embodiment variant of the furniture element 1. Here, the self-retraction apparatus 5 is not attached directly to the carrier plate 32, but to a respective pull-out guide 9.

In the exemplary embodiment shown, two pull-out guides 9 are provided, the guide rail 91 of which is attached to the side 322 of the carrier plate 32 facing away from the carcass 2.

The running rail 92 of the pull-out guide 9, which can be displaced relative to the guide rail 91, is coupled to the guide carriage 4, for example screwed or fixed with a material bond.

Here, too, a coupling element 8 serves to couple the guide carriage 4 to the running rail 92 of the pull-out guide 9.

The coupling element 8 has an approximately U-shaped carriage coupling part 81, from each of which a web-like running rail coupling part 82 extends on both sides and which is fastened to a respective running rail 92 of the pull-out guide 9.

As further shown in FIG. 9, the self-retraction apparatus 5 is attached to the guide rail 91 so that the self-retraction apparatus 5 can be activated by moving the running rail 92 relative to the guide rail 91.

It is also conceivable here to additionally attach an opening mechanism 6 to the guide rail 91 for opening the carcass 2.

A combination of the arrangements described above is also conceivable, so that, for example, the self-retraction apparatus 5 is attached to the pull-out guide 9, while the opening mechanism 6 is attached directly to the carrier plate 32 and corresponding activators are attached to the guide carriage 4, which activate the self-retraction apparatus 5 or the opening mechanism 6 when the guide carriage 4 is in a suitable position in each case.

FIG. 10 shows the underside of the carrier plate 32 facing away from the carcass 2 with pull-out guides 9 and guide carriage 4 attached to it in the end positions shown in FIG. 1 and FIG. 3, respectively. FIG. 11 shows the carrier plate 32 with pull-out guides attached to it with the running rails 92 pulled out, which corresponds to a decoupling of the running rail 92 from the self-retraction apparatus 5 analogously to FIG. 8.

It is also conceivable that the at least one self-retraction apparatus 5 has a damper for damping the closing movement of the carcass 2.

FIG. 12 shows a further exemplary embodiment of a furniture element according to the invention. Essential features correspond to the embodiment shown in FIG. 4, so that only the differences are briefly explained here.

In this exemplary embodiment, two opening mechanisms 6 were not used, but only one electrical or electromechanical opening mechanism 60 with a housing 61 and a movable plunger 62.

As can be further seen in FIG. 12, the guide carriage 4 has an additional coupling element 75 with a third activator 76. An ejection mechanism of such an opening mechanism 60 is described, for example, in EP 3532689 B1, to which reference is hereby made.

In FIG. 13, analogous to FIG. 7, a view from below is shown of the carrier plate 32 with guide carriage 4, self-retraction apparatus 5 and opening mechanism 60 arranged thereon in the closed starting position of the furniture element.

The opening mechanism 60 is arranged in extension of the guide channel 323 between the two self-retraction apparatuses 5. The additional coupling element 75 is arranged above the coupling element 7 in the longitudinal direction of the guide carriage 4, and the third activator 76 rests against the plunger 62 of the opening mechanism.

When pressure is applied to a side wall 21 of the carcass, the plunger 62 is pressed in the direction of the housing 61 and the opening mechanism 60 is actuated. In this case, the plunger 62 is tensioned with the aid of electrical energy.

In the exemplary embodiments, a lower translational-rotational fitting 3 is shown in each case. Alternatively, this can also be arranged in mirror image on the upper side of the carcass 2 of the furniture element 1. A lower and an upper translational-rotational fitting 3 may also be present. In this case, both or only one of them may be equipped with at least one self-retraction apparatus 5 according to the invention.

In the further embodiment variant shown in FIGS. 14 and 15, at least one opening mechanism 6 for opening the carcass 2 is arranged at a distance from the guide channel 323 in a side region of the carrier plate 32.

There is no coupling of the at least one opening mechanism 6 to the guide carriage 4 in this embodiment variant. For activation, a surface of the carcass 2 or the bearing plate 31 of the translational-rotational fitting 3 or an activator 13 arranged on the carcass 2 or the bearing plate 31 is brought into engagement with the opening mechanism 6 in this embodiment variant.

As shown in FIGS. 14 and 15, in this embodiment variant the carrier plate 32 of the translational-rotational fitting 3 has a slider 327 which is displaceable under spring load from a first position projecting from an end face of the carrier plate 32 by a first dimension into a second position projecting by a second dimension, with the first dimension being greater than the second dimension. In extreme cases, the second dimension can assume a value of zero.

This embodiment variant makes it possible to carry out the translational-rotational movement described above in such a way that in no rotational position of the furniture element 1 does a section of the carrier plate 32 protrude beyond the base surface of the furniture element 1, while still supporting the furniture element over a large area, in particular supporting the furniture element over its entire surface in the region of the starting and open position.

As further shown in FIGS. 14 and 15, two such opening mechanisms 6 are preferably provided, here in the form of cartridges, with a housing 61 fixed in a respective receptacle 326 of the carrier plate 32 and a spring-mounted plunger 62 linearly movable in the housing 61. This enables the opening mechanism 6 to be activated in two opposite directions of rotation.

An activator 13, which is attached to a side surface of the bearing plate 31 and extends over the side of the bearing plate 31 facing the carrier plate 32 into the range of movement of the plunger 62, serves here as an abutment against which the plunger 62 is pressed to activate the opening mechanism 6. The fastening is preferably by screwing, but riveting or gluing is also conceivable, for example.

In the exemplary embodiment, two activators 13 are arranged at different positions of the bearing plate 31. Depending on the positioning of the opening mechanisms 6, one activator 13 may be sufficient or more than two activators 13 may be present.

It is also conceivable to form the activator 13 integrally with the bearing plate 31 instead of an activator 13 attached to the bearing plate 31.

It is also conceivable to fasten or integrally form the activator 13 in the edge region of one of the side walls 21,22 of the carcass 2 of the furniture element.

Also in this embodiment variant, when pressure is applied to a side wall 21 of the carcass, the plunger 62 is pressed further into the housing 61. This is carried out by moving the bearing plate 31 of the translational-rotational fitting 3, which is stationarily coupled to the carcass 2, against the restoring force of a spring element of the cartridge.

By activating the opening mechanism 6, the plunger 62 is pushed out of its housing 61 with the help of the spring force of the spring element of the cartridge, thus initiating the translational-rotational movement of the bearing plate 31 and thus of the carcass 2 of the furniture element 1 relative to the carrier plate 32.

In the embodiment variant shown in FIGS. 16-19, the opening mechanism 6 is designed as an electromotively driven opening mechanism having a plunger 62 mounted in a housing 61 and drivable by an electric motor.

As shown in FIGS. 16 and 17, the housing 61 of the opening mechanism 6 is attached laterally to the carrier plate 32. In the embodiment variant shown here, as shown in particular in FIG. 17, the activator 13 is accommodated, in particular inserted, in a receptacle provided for this purpose in the bearing plate 31.

FIG. 18 shows a translational-rotational fitting 3 arranged on the carcass 2 of the furniture element 1 before the opening mechanism 6 is triggered, in which the plunger 62 is largely or completely accommodated in the housing 61.

FIG. 19 shows a fixed furniture element 15 next to a furniture element 1 with translational-rotational fitting 3, in which the opening mechanism 6 is triggered.

As shown here, the plunger 62 protrudes largely from the housing 61 of the opening mechanism 6. By contact of the end face of the plunger 62 with the activator 13, which is connected in a stationary manner to the carcass 2 via the bearing plate 31, the triggering of the opening mechanism 6 has resulted in a relative movement of the carcass 2 of the furniture element 1 relative to the stationary furniture element 15.

In the embodiment variant shown in FIGS. 20-26, instead of the exemplary embodiment shown in FIGS. 4-8, the coupling element activating the self-retraction apparatus 5 is integrated in the guide carriage 4'.

The guide carriage 4' here has a base body 41' extended in the longitudinal direction of the guide channel 323 of the carrier plate 32 compared to the guide carriage 4 shown in FIGS. 4, 9 and 12.

Protruding from the base body 41', analogously to the structure of the guide carriage 4 according to FIG. 4, but here in the region of a first end of the base body 41', is the guide pin 43', the free end of which is rotatably fixed in the receptacle 311 of the bearing plate 31 of the translational-rotational fitting 3.

For rotatably fixing a free end of the guide pin 43', a rotary bearing 14 is received in the receptacle 311 of the bearing plate 31.

In the region of an end of the base body 41' of the guide carriage 4' remote from the guide pin 43', the first activators 71' protrude on both sides, which are coupled to a respective self-retraction apparatus 5 in a manner analogous to the operation of the first activators 71 of the coupling element 7, as shown in FIGS. 22, 24 and 26.

Further, in contrast to the embodiment variant shown in FIGS. 4, 9 and 12, the guide carriage 4' does not have wheels 42 attached to the side of the base body 41, but rather sliding surfaces 42' that rest in a sliding manner on carriage tracks 324 of the carrier plate 32, as shown, for example, in FIGS. 21, 23 and 25.

FIG. 21 shows a translational-rotational fitting 3 with a guide carriage 4' as described above in a positioning of the bearing plate 31 relative to the carrier plate 32 corresponding to the starting position or open position of the carcass 2 with the self-retraction apparatus 5 not tensioned.

As shown in the detailed view in FIG. 22, the first activator 71' is engaged with a driver 51 of the self-retraction apparatus 5.

FIG. 23 shows a relative position of the carrier plate 32 to the bearing plate 31, in which the carcass 2 is in an intermediate position between the starting position and the open position.

The self-retraction apparatus 5 is here in a tensioned state. The driver 51 of the self-retraction apparatus 5 is locked here in a tensioning position, as shown in the detailed illustration in FIG. 24. The first activator 71 is disengaged from the driver 51.

FIG. 25 shows a relative position of the carrier plate 32 relative to the bearing plate 31 of the translational-rotational fitting 3, at which the self-retraction apparatus 5 is activated.

In this position, as shown in FIG. 22, the first activator 71' comes back into contact with the driver 51 and releases the latter from its locking, so that when the driver 51 is subsequently moved back into the position shown in FIGS. 21 and 22, the guide carriage 4' is pulled into the starting position by the coupling of the first activator 71' with the driver 51, so that the carcass 2 of the furniture element 1 is moved into the starting position or open position.

FIGS. 27-32 show an alternative embodiment variant of such a self-retraction apparatus 5.

In this embodiment variant, the self-retraction apparatus 5 has a toggle lever with a pendulum lever 51 pivotally attached to the guide carriage 4 and a power lever 52 pivotally coupled to the pendulum lever 51 and pivotally attached to the carrier plate 32.

Furthermore, the self-retraction apparatus 5 has at least one energy storage device 53 held on the carrier plate 32, which is arranged on the power lever 52, as shown here, or on the pendulum lever 51.

In this embodiment variant, the guide carriage 4 is basically constructed in the same way as the embodiment variant shown in FIGS. 4, 9 and 12.

Instead of the wheels 42, in this embodiment variant of the guide carriage 4, bearing surfaces are integrally formed on the side from which the guide pin 43 protrudes and rest on a rolling bearing 44 provided between the guide carriage 4 and carriage tracks 324 of the carrier plate 32 to enable the guide carriage 4 to be displaced along the guide channel 323 of the carrier plate 32 with low friction.

A first end of the pendulum lever 51 is pivotally attached to the rear side of the guide carriage 4 below the guide pin 43. The second end of the pendulum lever 51 is pivotably coupled to a first end of the power lever 52.

In the embodiment variant shown here, two energy storage devices 53 designed as tension springs are fixed to the power lever 52 at different distances from the bearing for the pendulum lever 51.

The power lever 52 is pivotally mounted on the carrier plate 32 at its end spaced from the bearing for the pendulum lever 51 by means a pivot bearing 55.

The pivot bearing 55 is positively secured in a receptacle provided for this purpose in the carrier plate 32.

The second ends of the energy storage devices 53 are also attached to the carrier plate 32 via a fastening bearing 56.

As further shown in FIGS. 27 and 28, a damper 54 is additionally arranged between the power lever 52 and the fastening bearing 56, by means of which the self-retraction apparatus 5 enables a damped movement of the carcass 2 into the starting position or the open position shortly before the starting position or the open position is reached.

By utilizing such a toggle function of the self-retraction apparatus 5, it is possible to enable the self-retracting function over a wide angular range of the rotational motion portion of the translational-rotational fitting 3.

For example, the embodiment variant shown here allows the self-retraction apparatus 5 to be triggered in a range of 30-40° before it enters the starting position or the open position.

In addition, damping of the entry movement with the aid of the damper 54 can also begin much sooner in the course of movement of the carcass 2, resulting in a uniform speed curve when opening and closing the carcass 2.

Furthermore, the angular position of the pendulum lever 51 and the power lever 52 makes it possible that during the rotational movement of the carcass 2 in an angular rotation range of preferably 45°-135°, no or only slight forces are introduced along the guide carriage 4 into the translational-rotational fitting 3, which enables a force-free rotation of the furniture element 1.

In order to keep the translational-rotational fitting 3 as flat as possible even with such a self-retraction apparatus 5, the carrier plate 32 has a power lever receptacle 328 within which the power lever 52 can be moved.

A guide groove 329 in the carrier plate 32 provides additional guidance for the power lever 52 by extending an axle that holds the damper 54 to the power lever 52 so that it projects into the guide groove 329 of the carrier plate 32.

FIG. 29 shows a furniture element 1 rotated by about 25° relative to a fixed furniture element 15.

FIG. 30 shows the furniture element 1 in a position rotated by about 45° relative to the fixed furniture element 15.

LIST OF REFERENCE SIGNS

Figure 1:
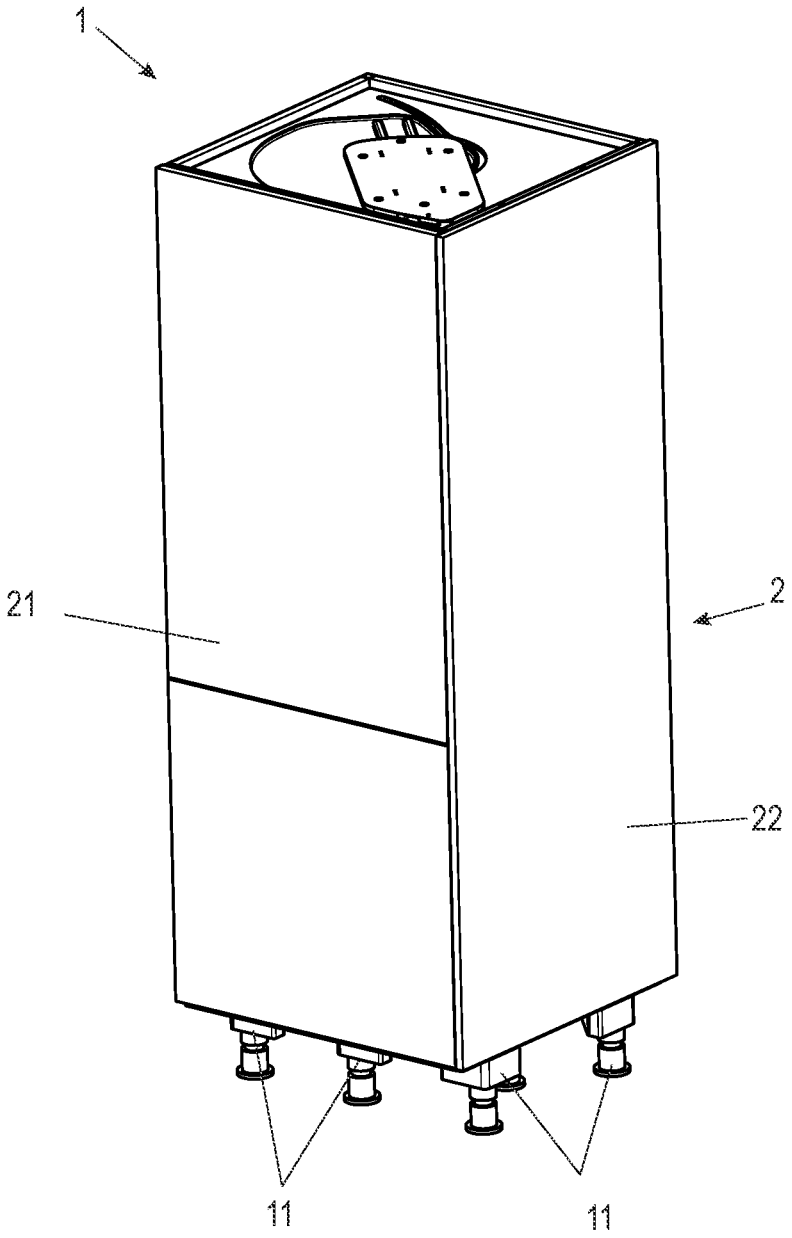
Figure 2:
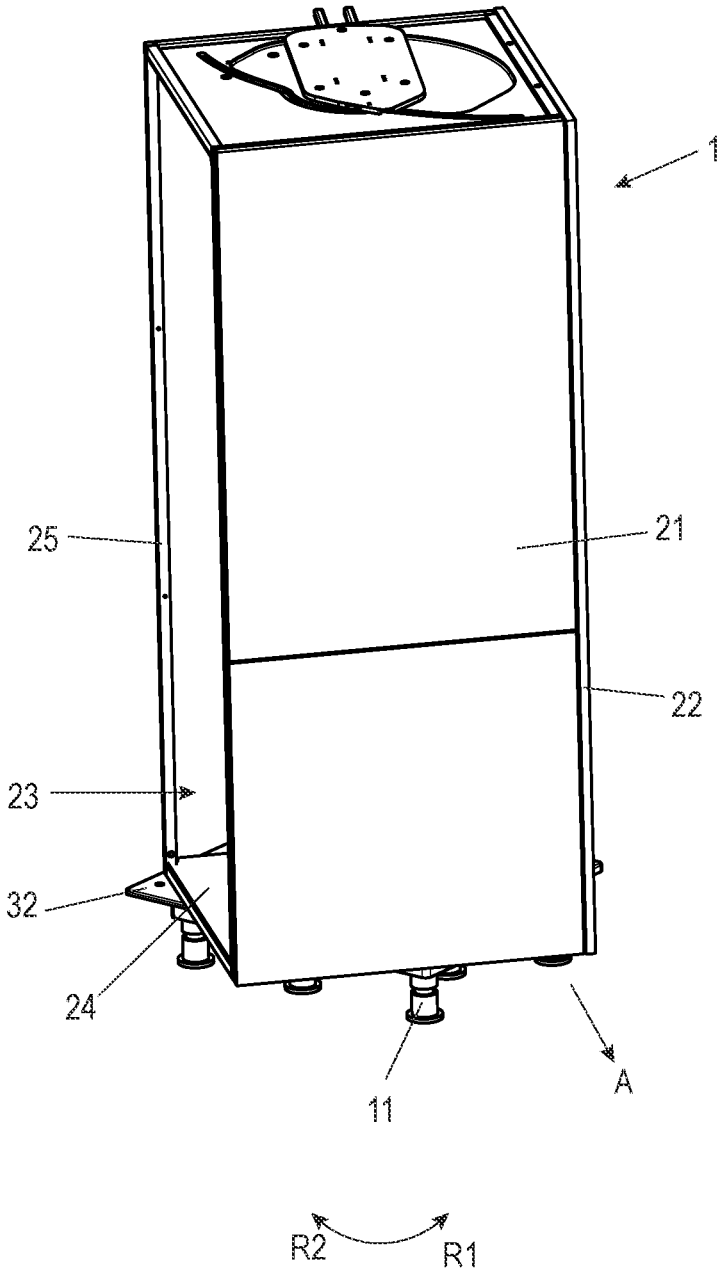
Figure 3:
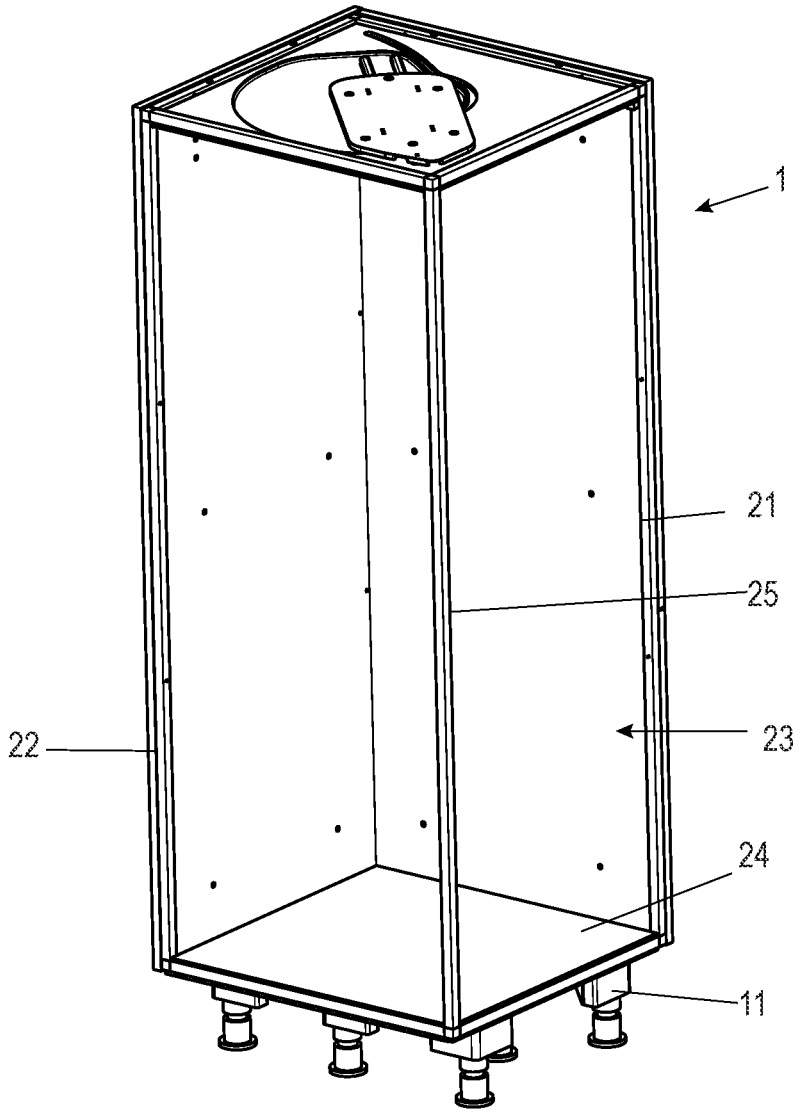
Figure 4:
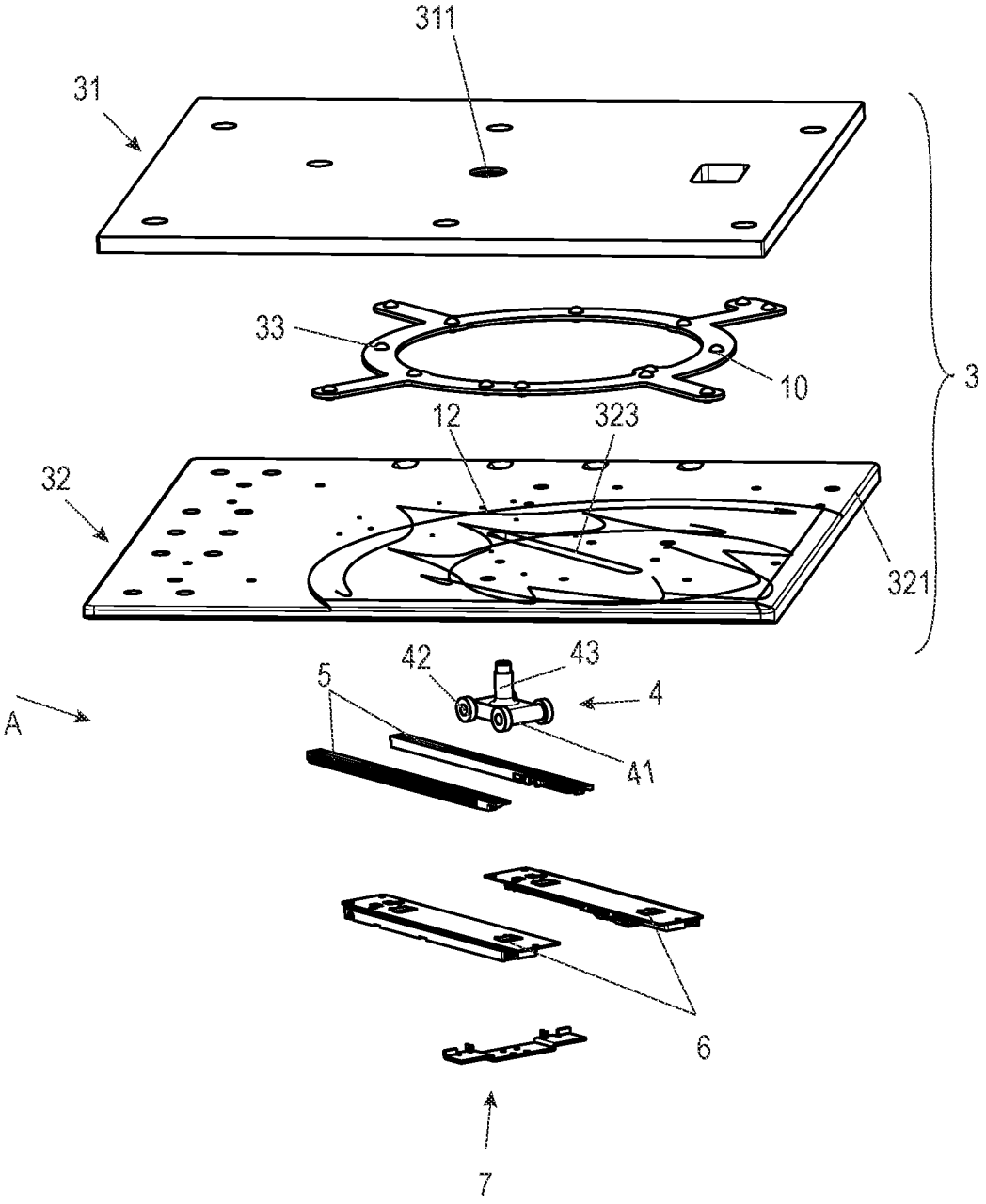
Figure 5:
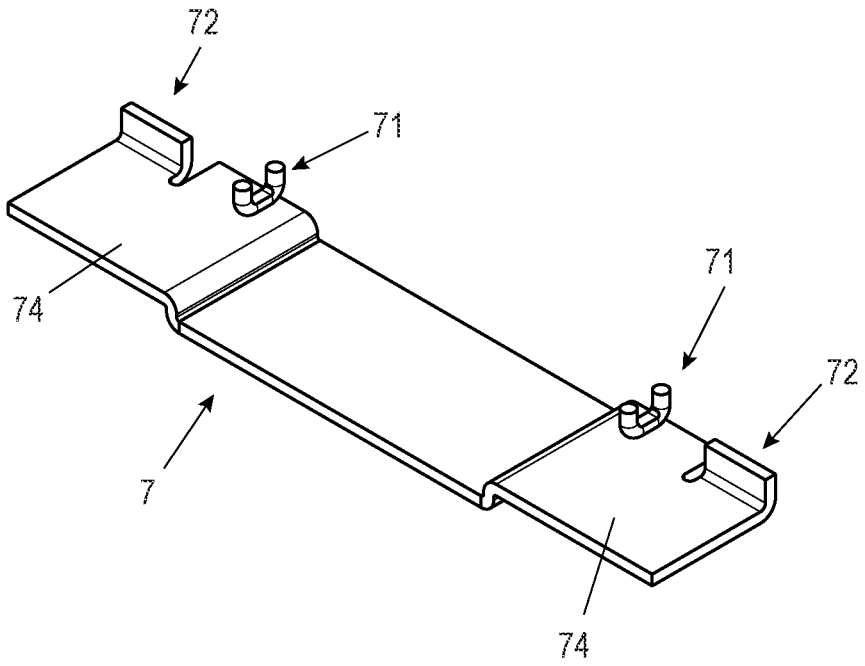
Figure 6:
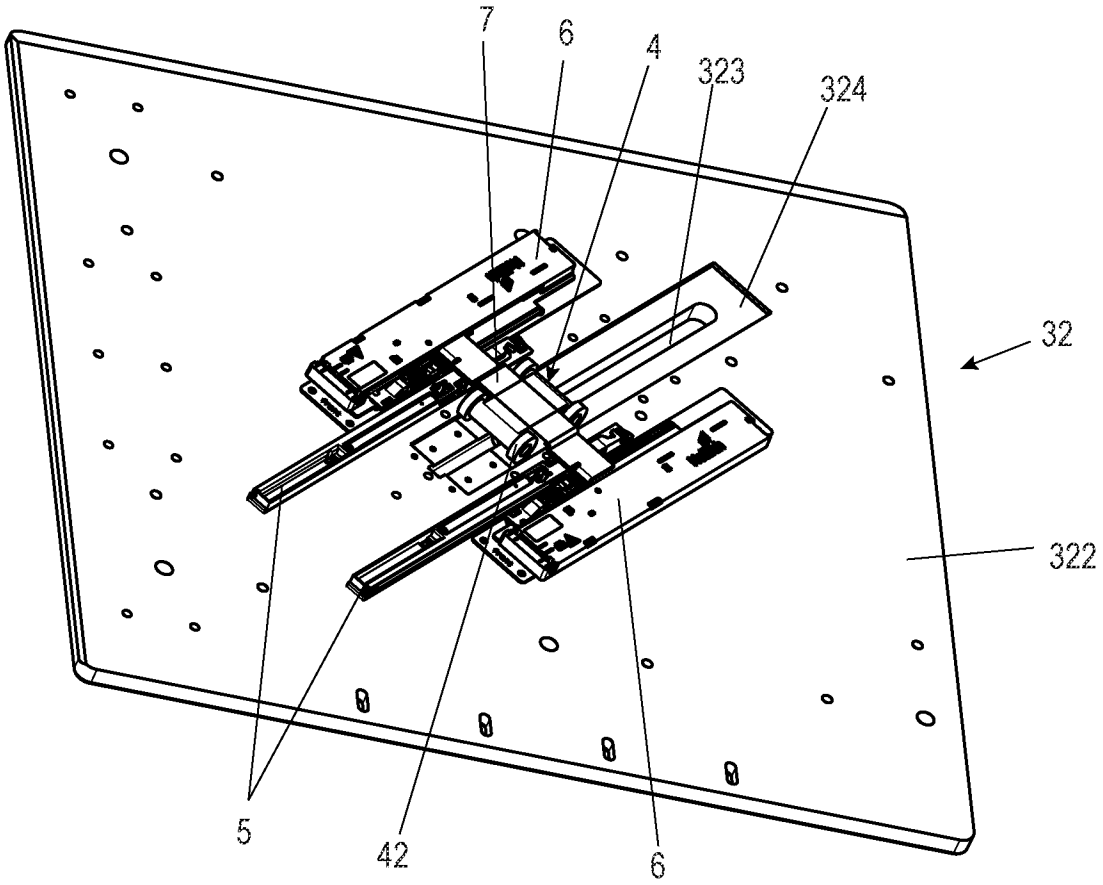
Figure 7:
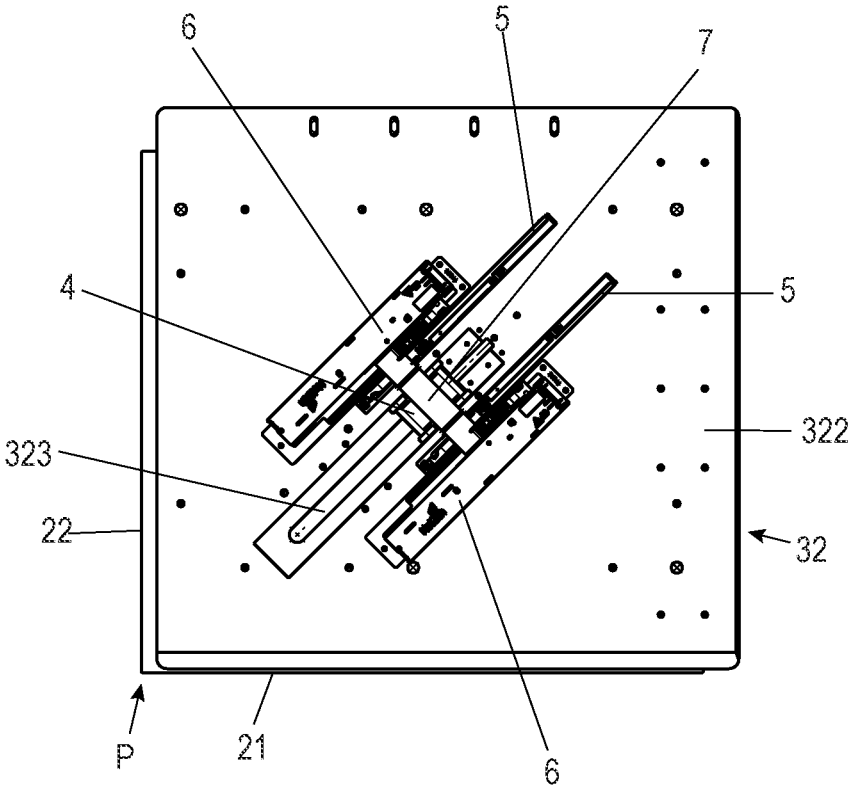
Figure 8:
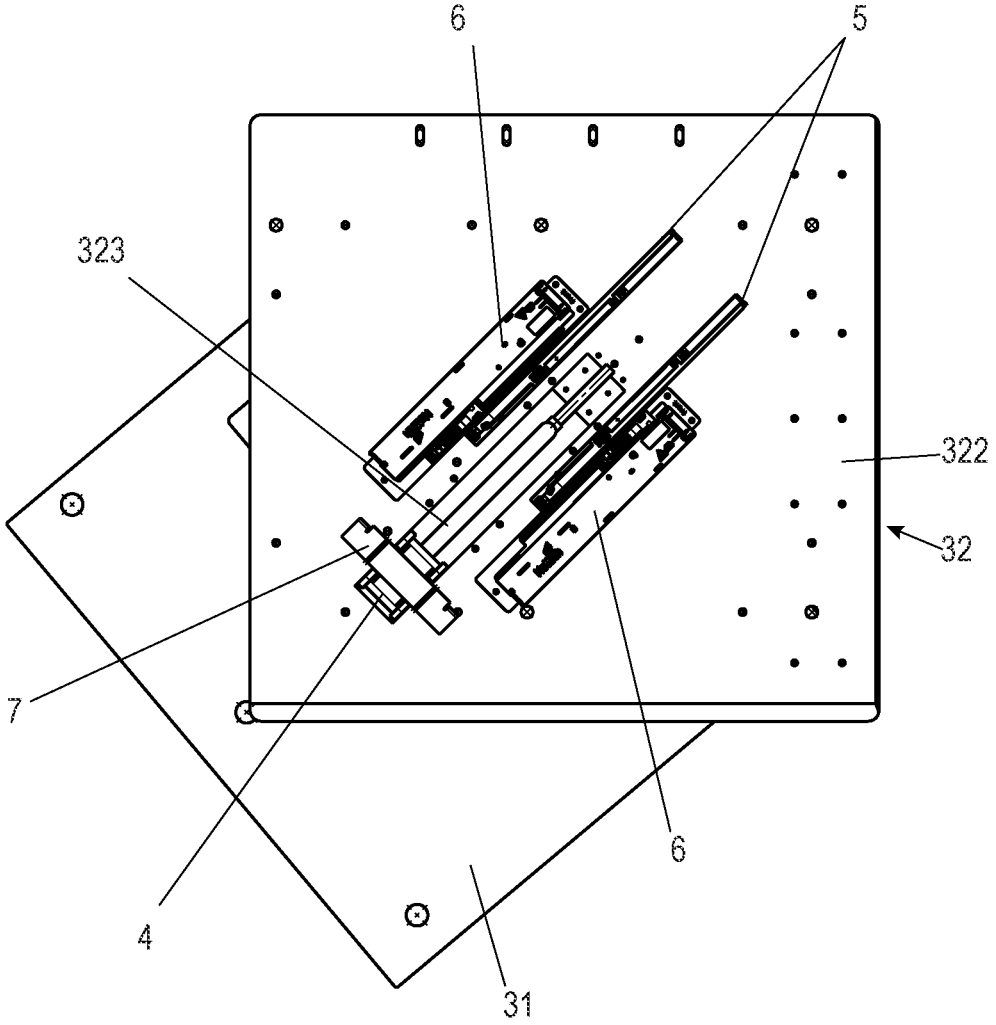
Figure 9:
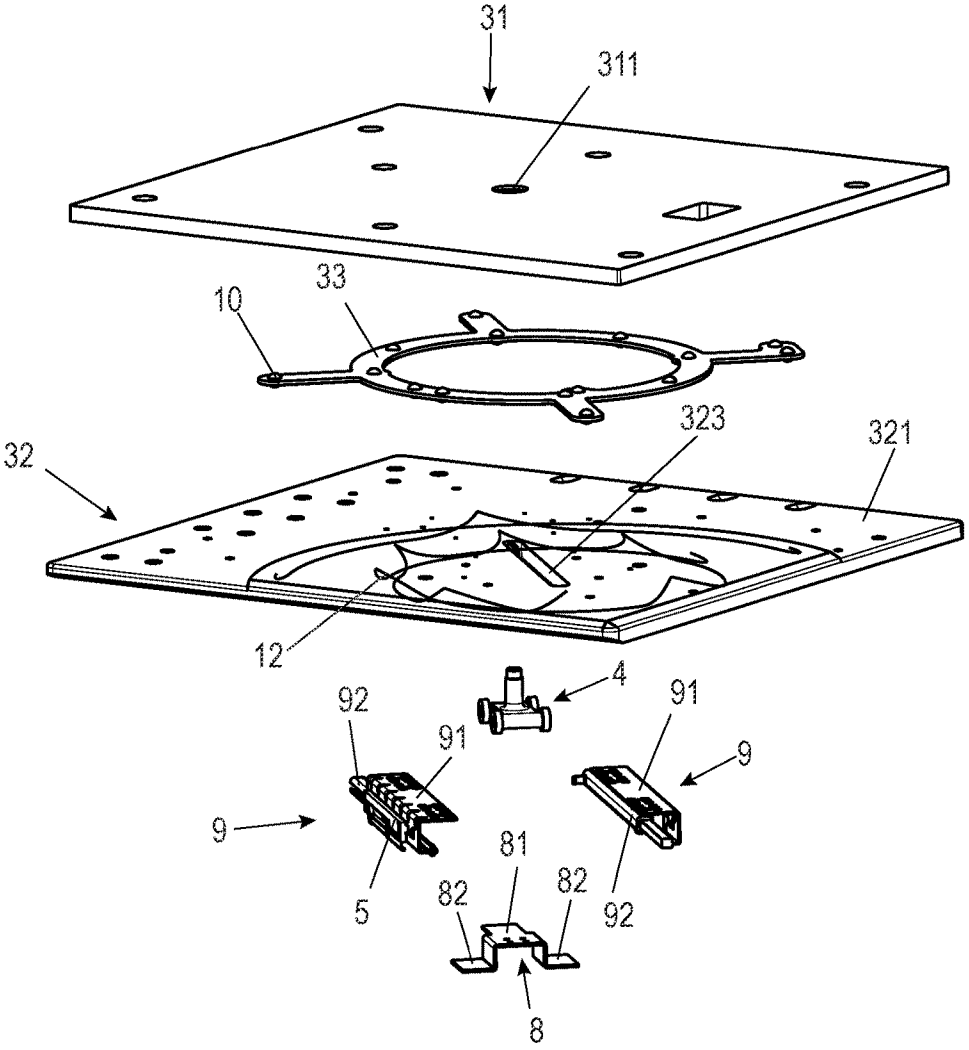
Figure 10:
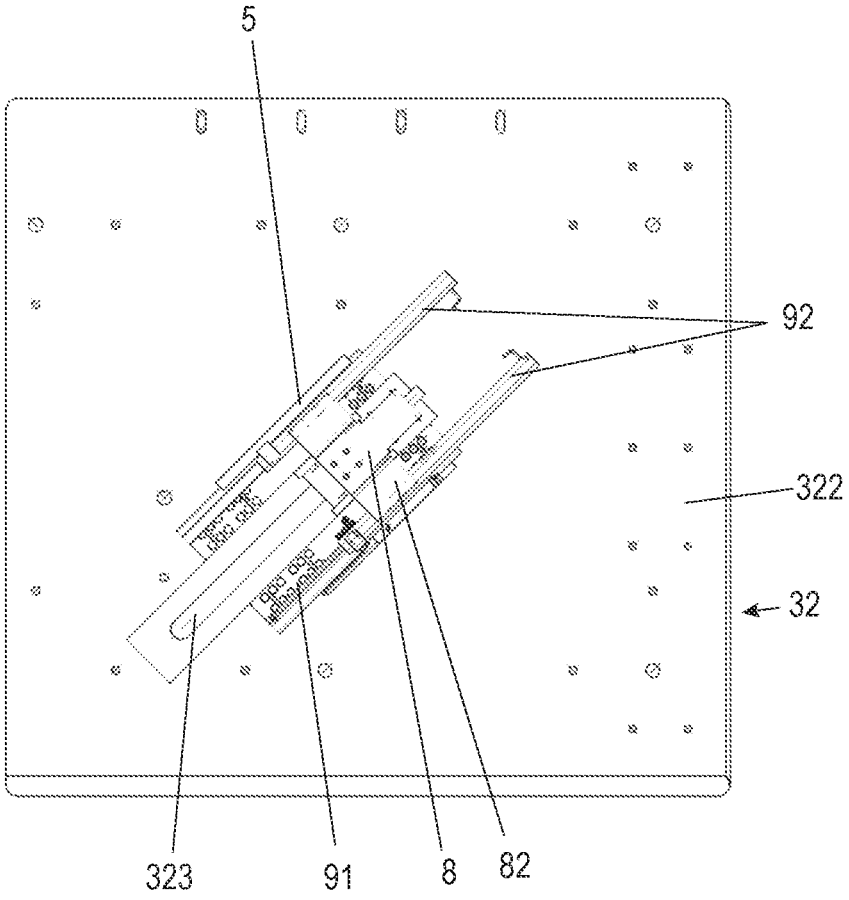
Figure 11:
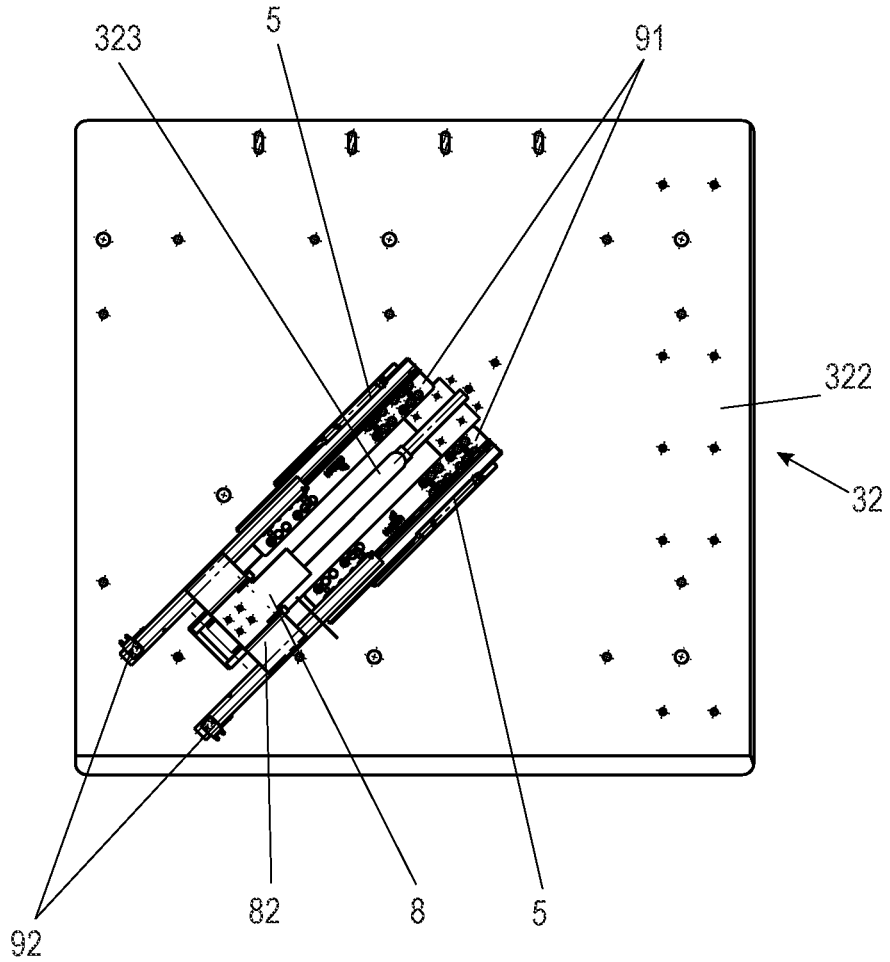
Figure 12:
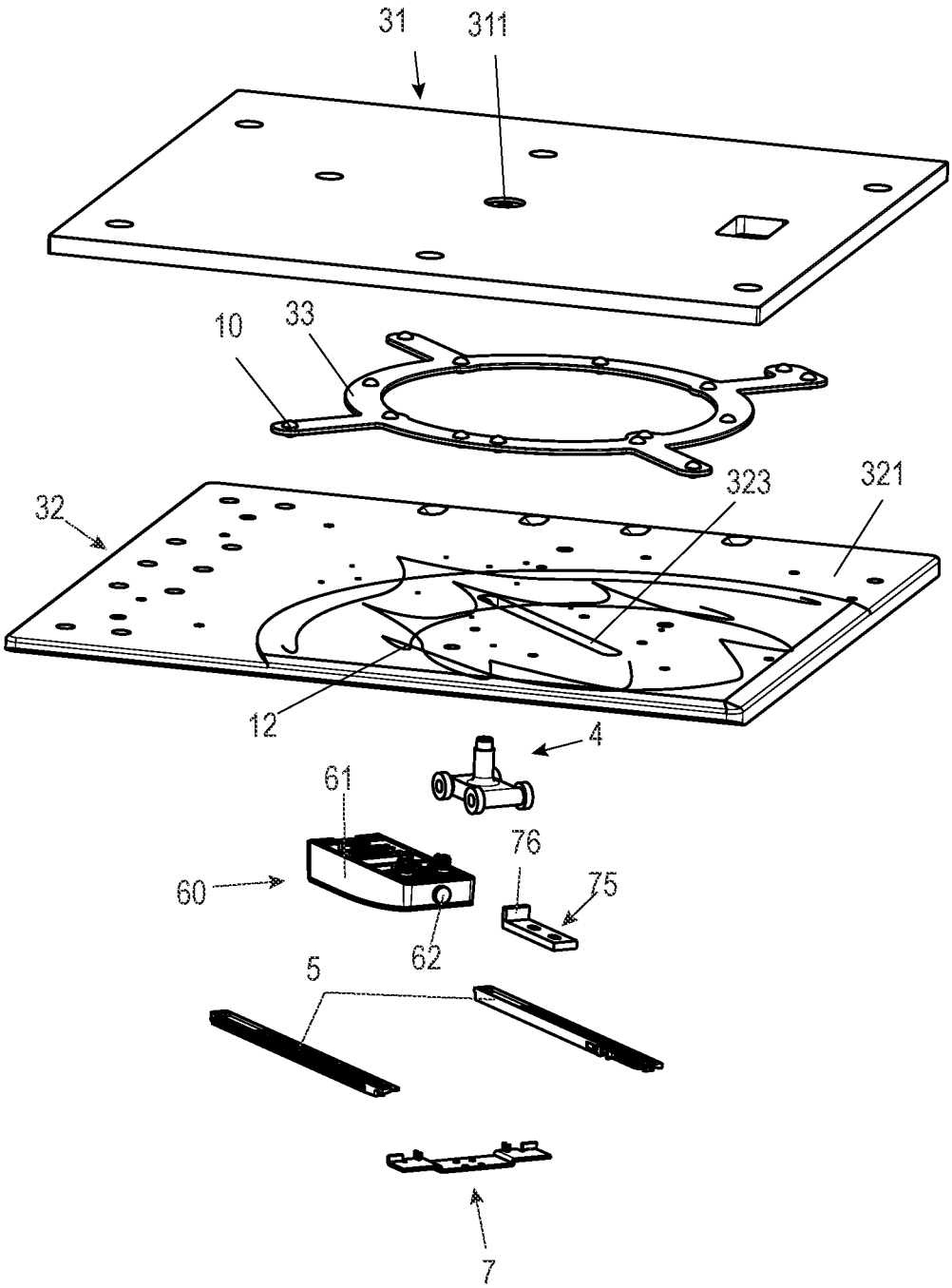
Figure 13:
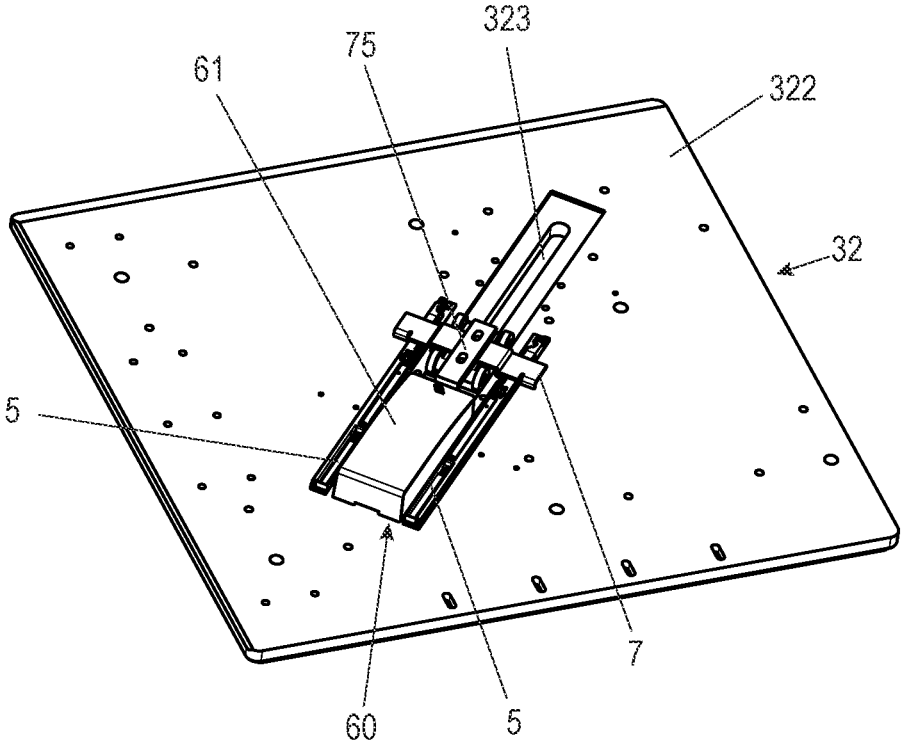
Figure 14:
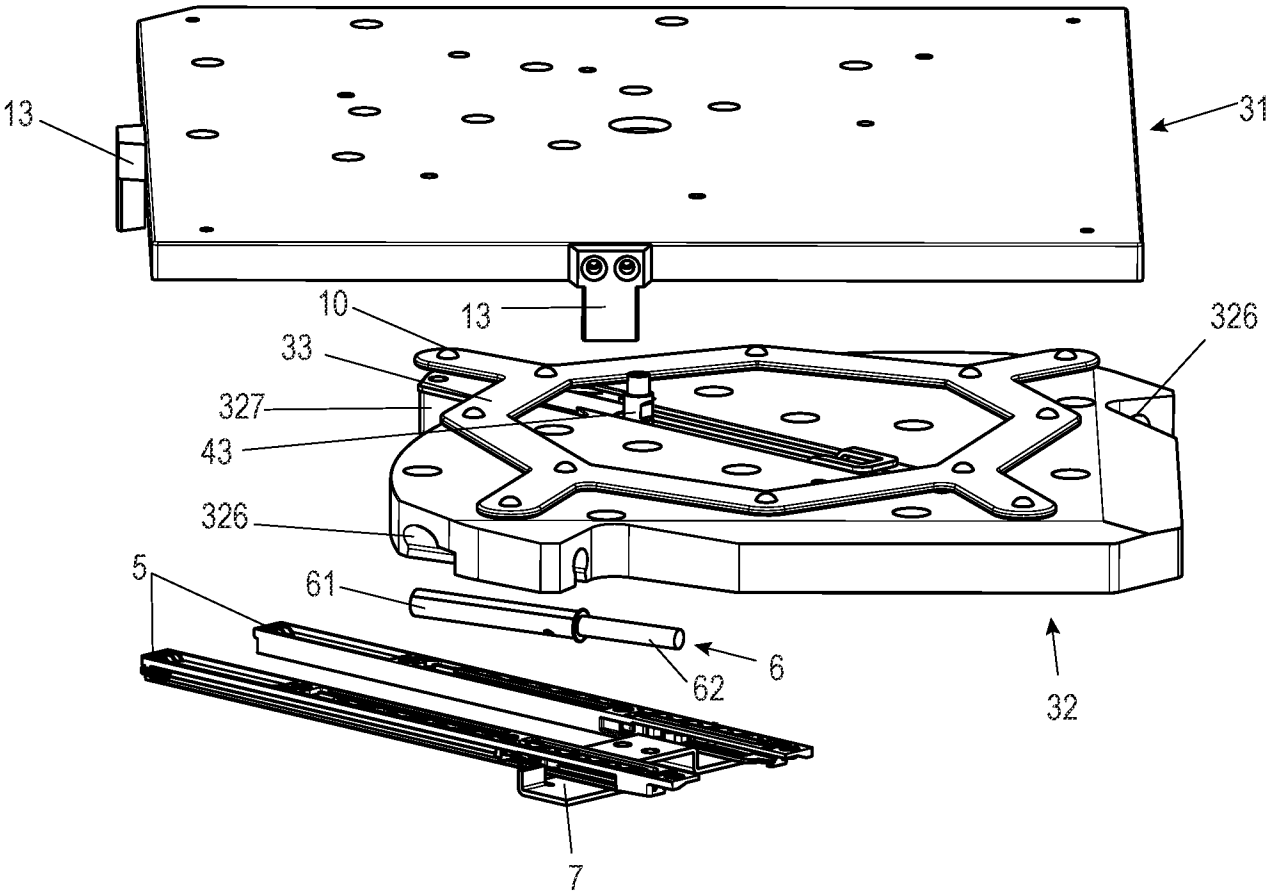
Figure 15:
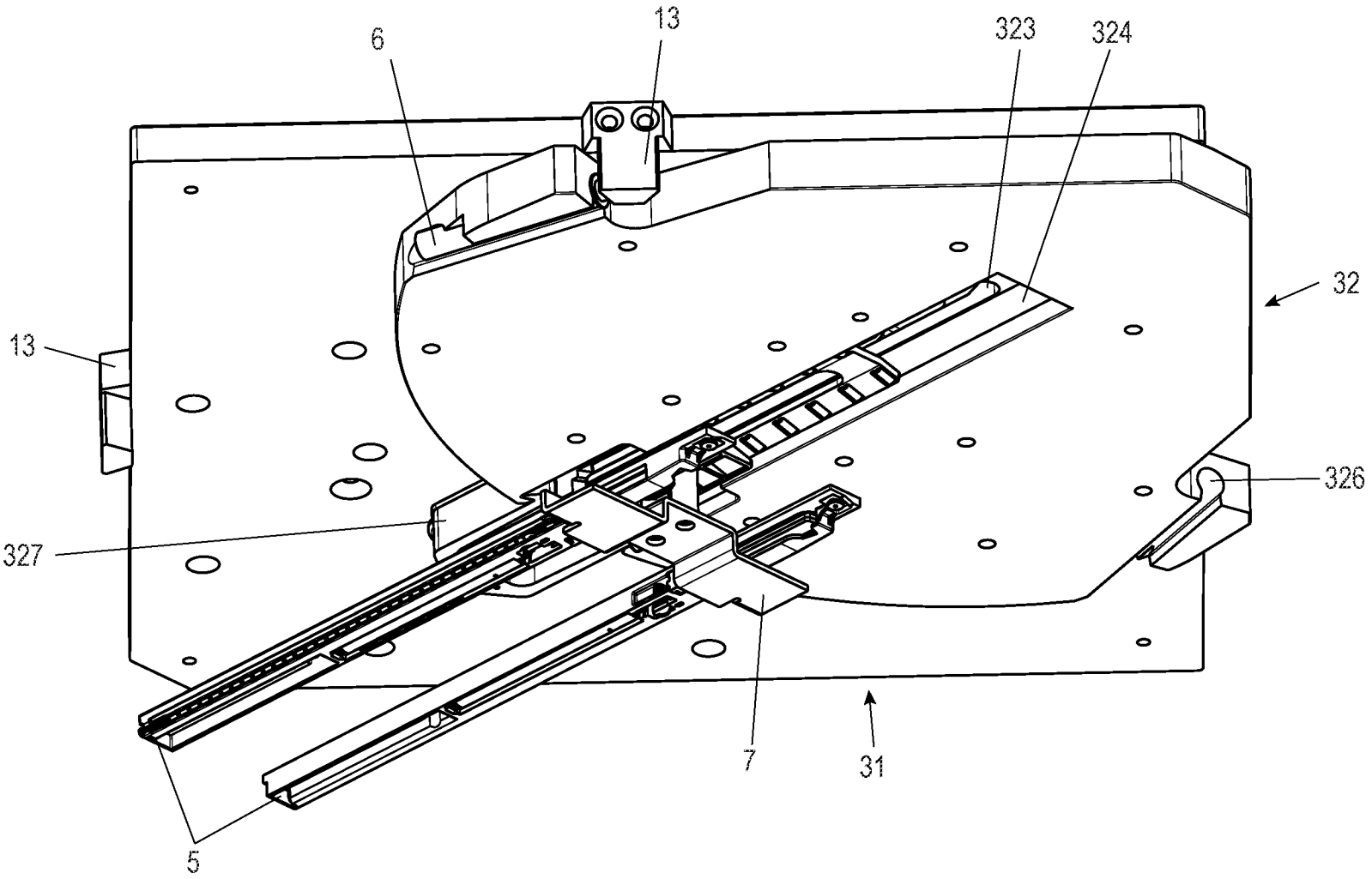
Figure 16:
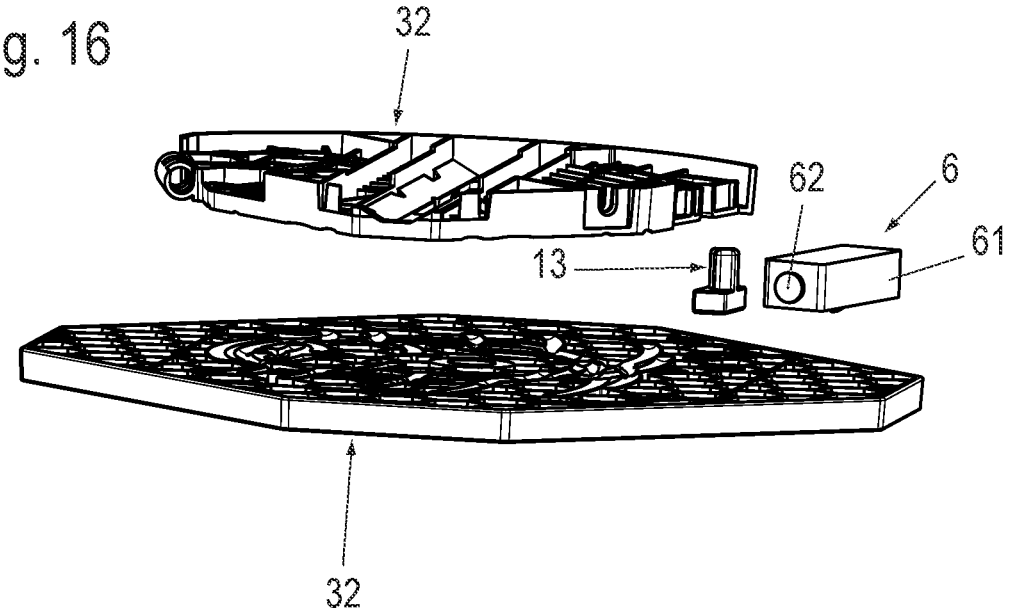
Figure 17:
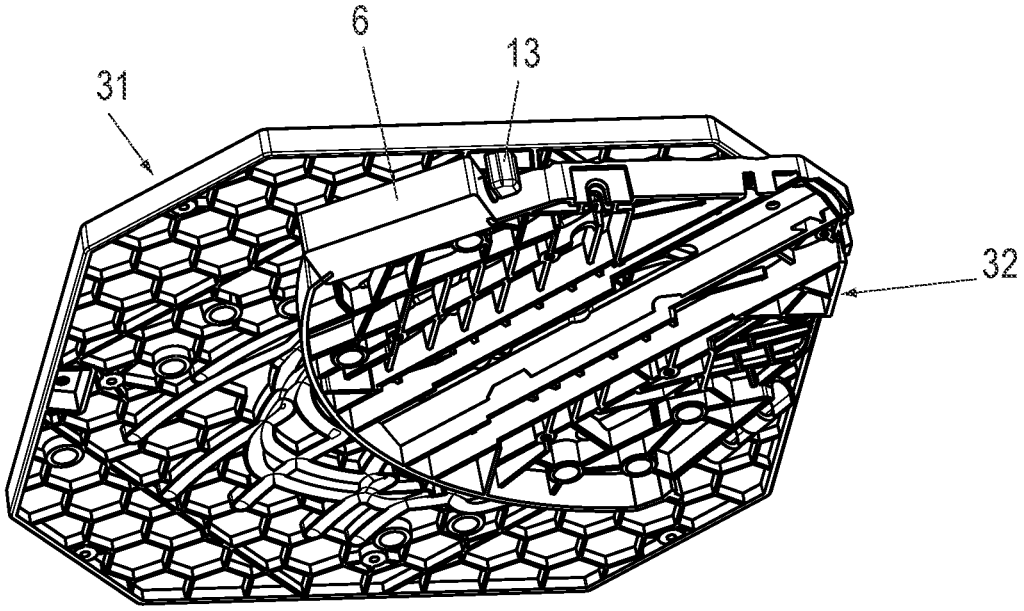
Figure 18:
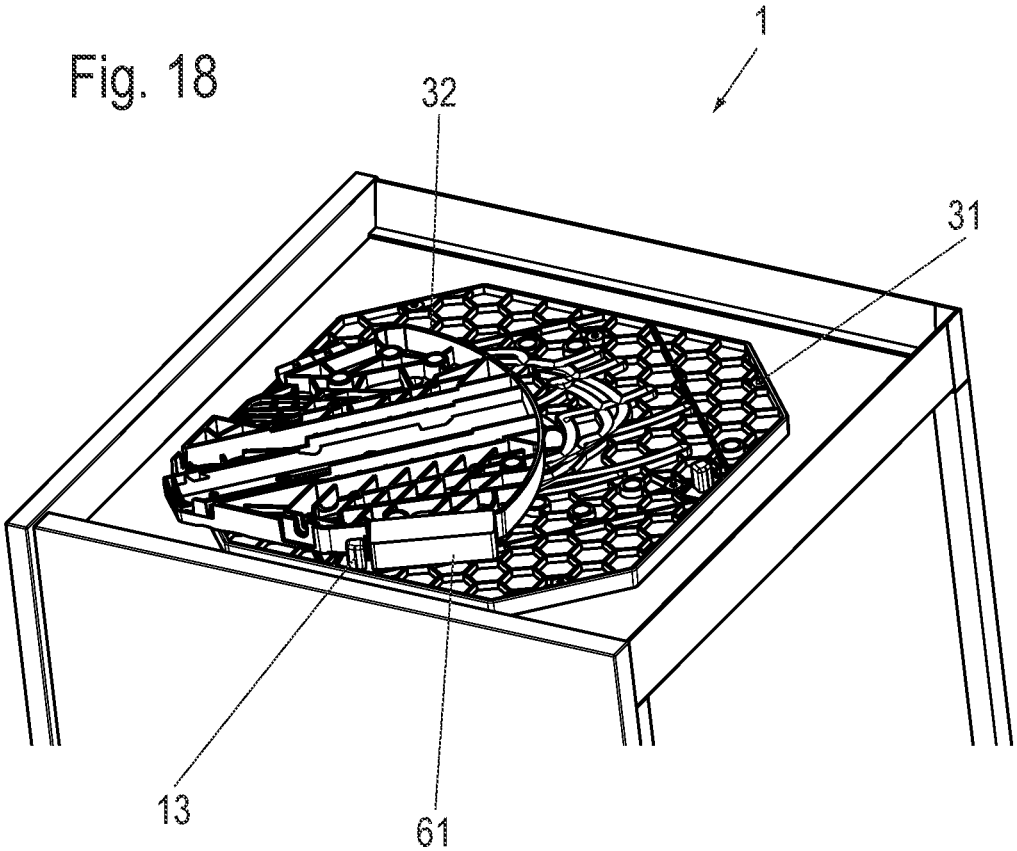
Figure 19:
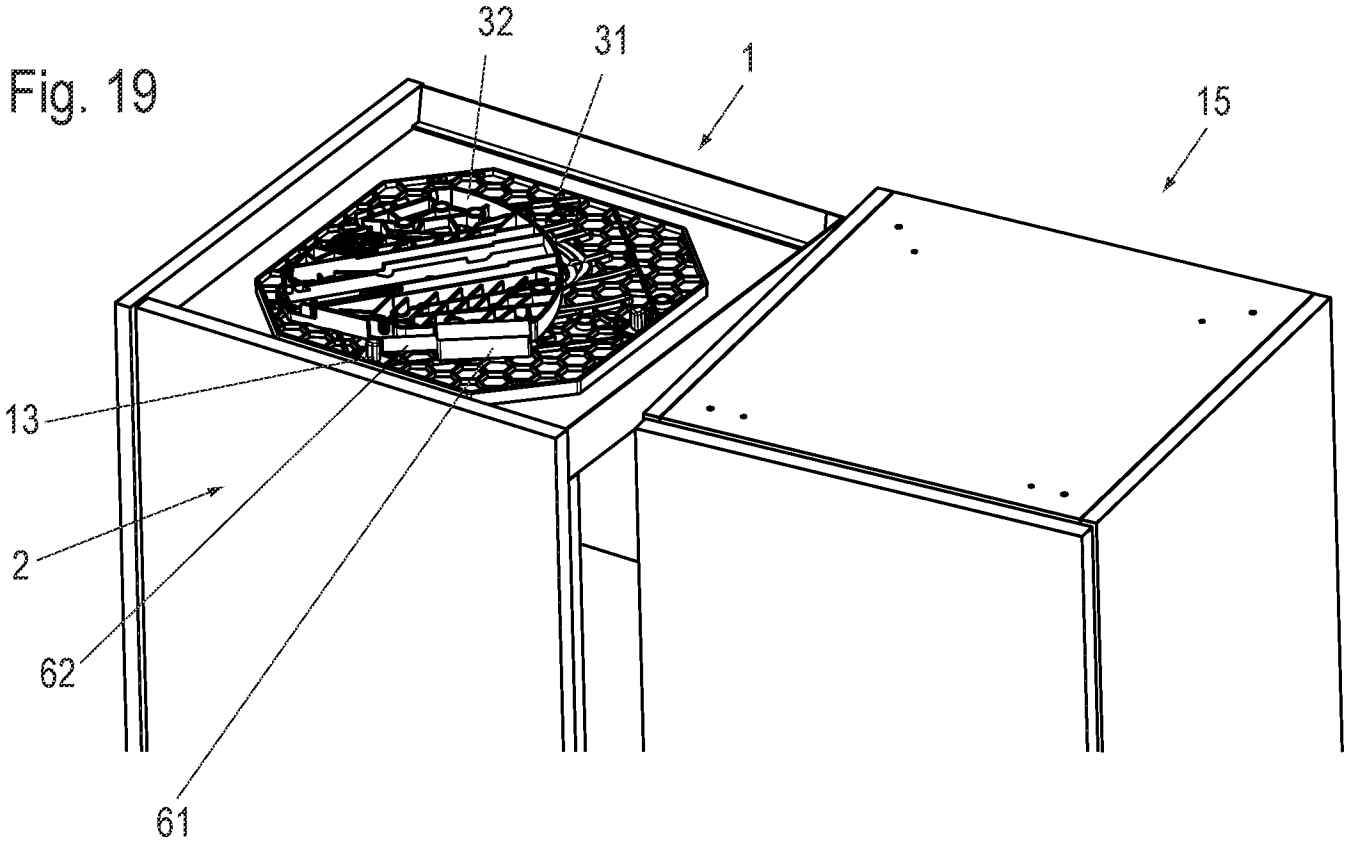
Figure 20:
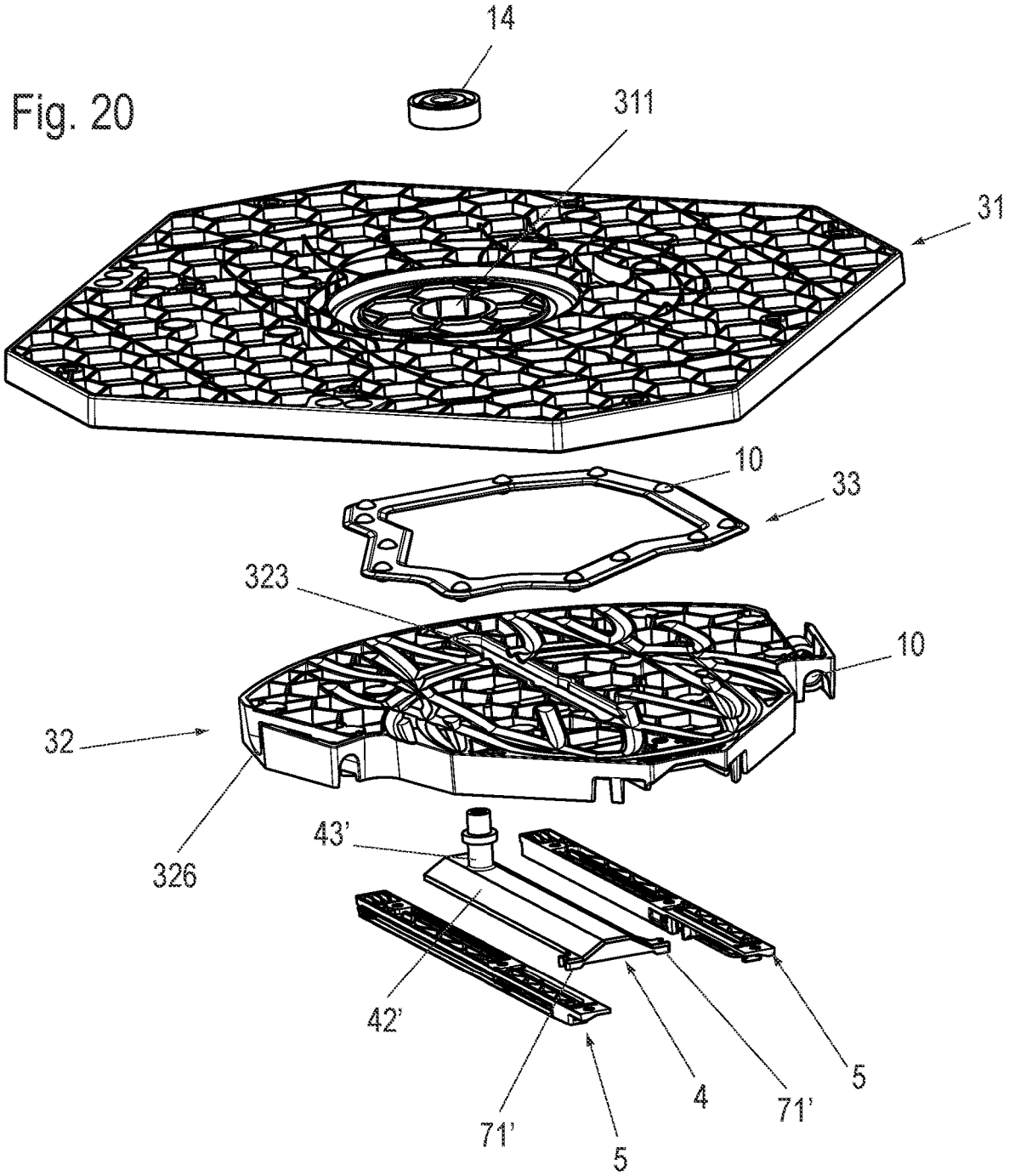
Figure 22:
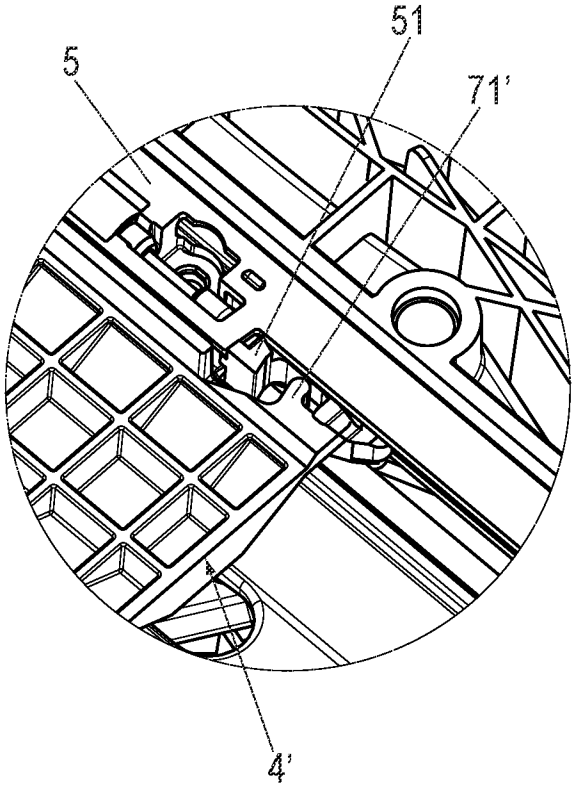
Figure 21:
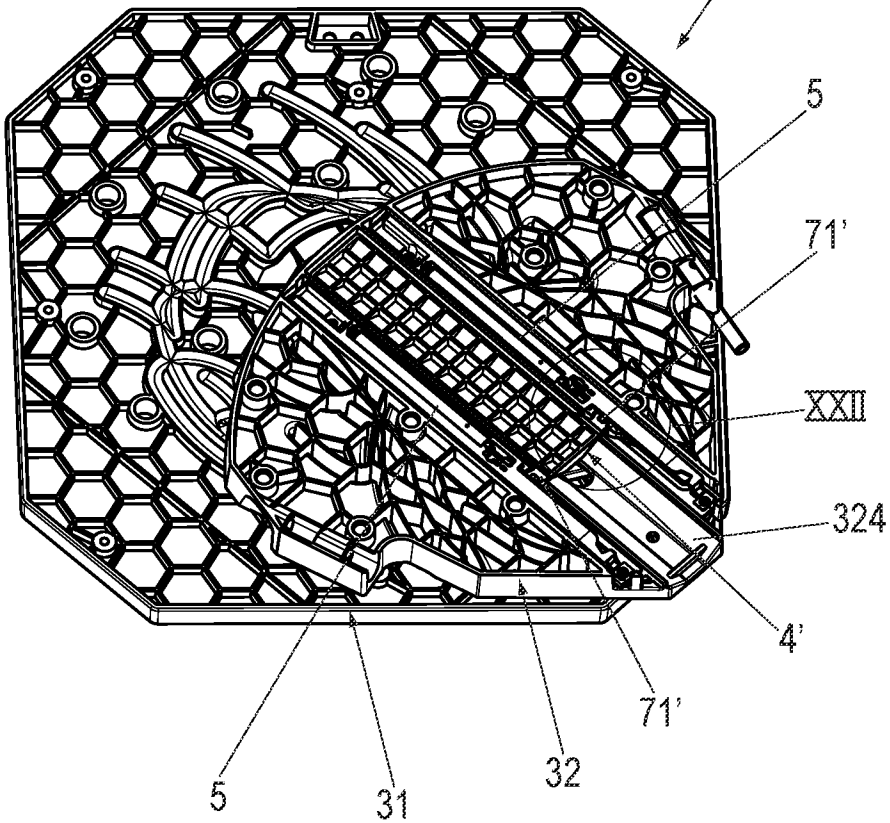
Figure 24:
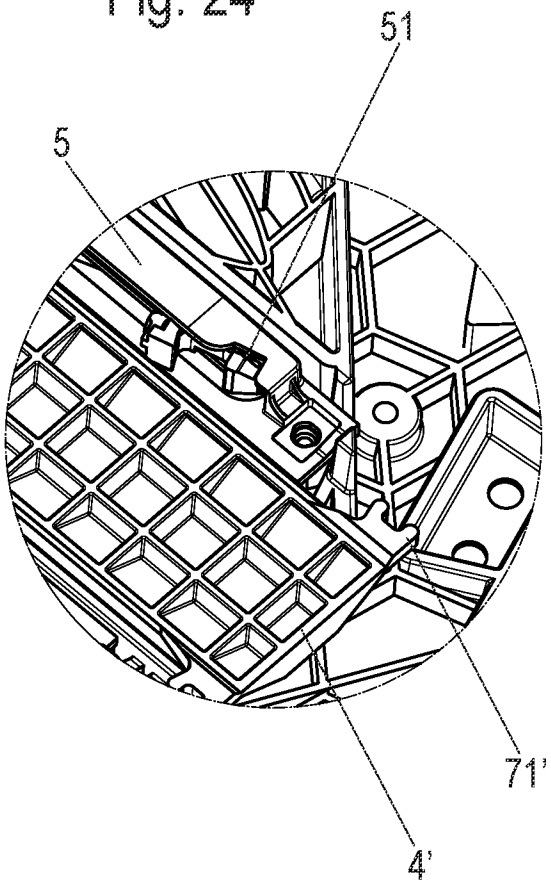
Figure 23:
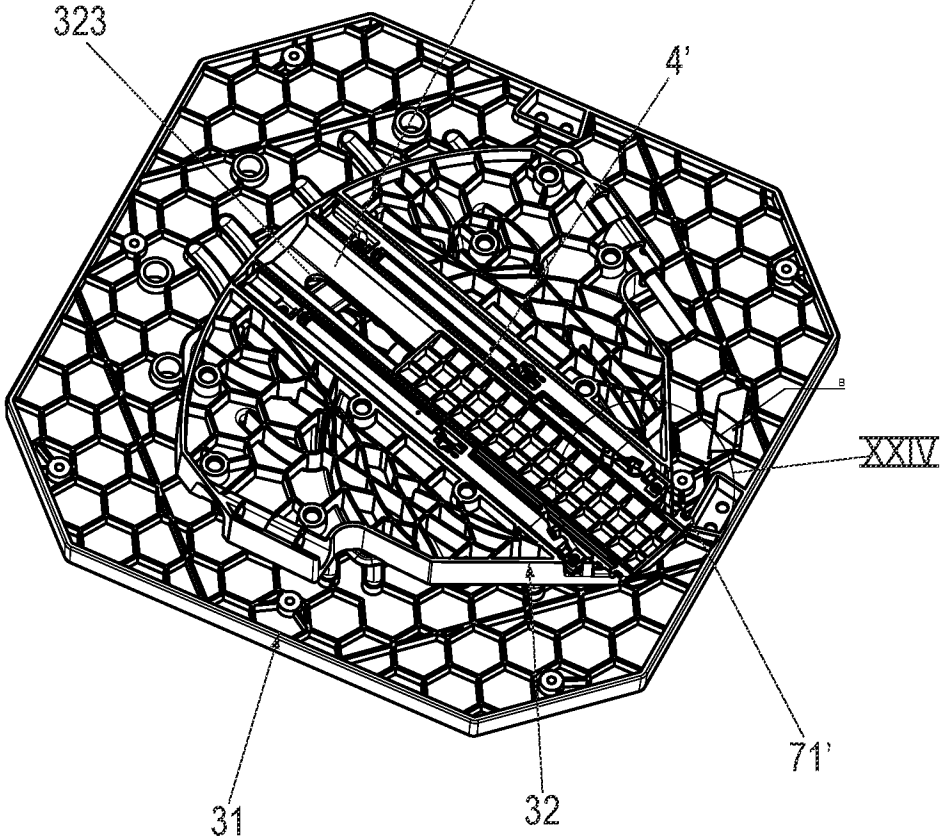
Figure 26:
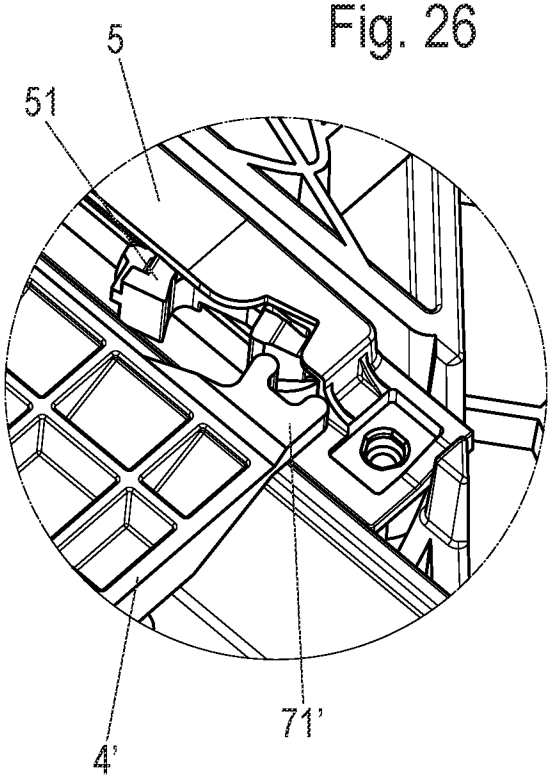
Figure 25:
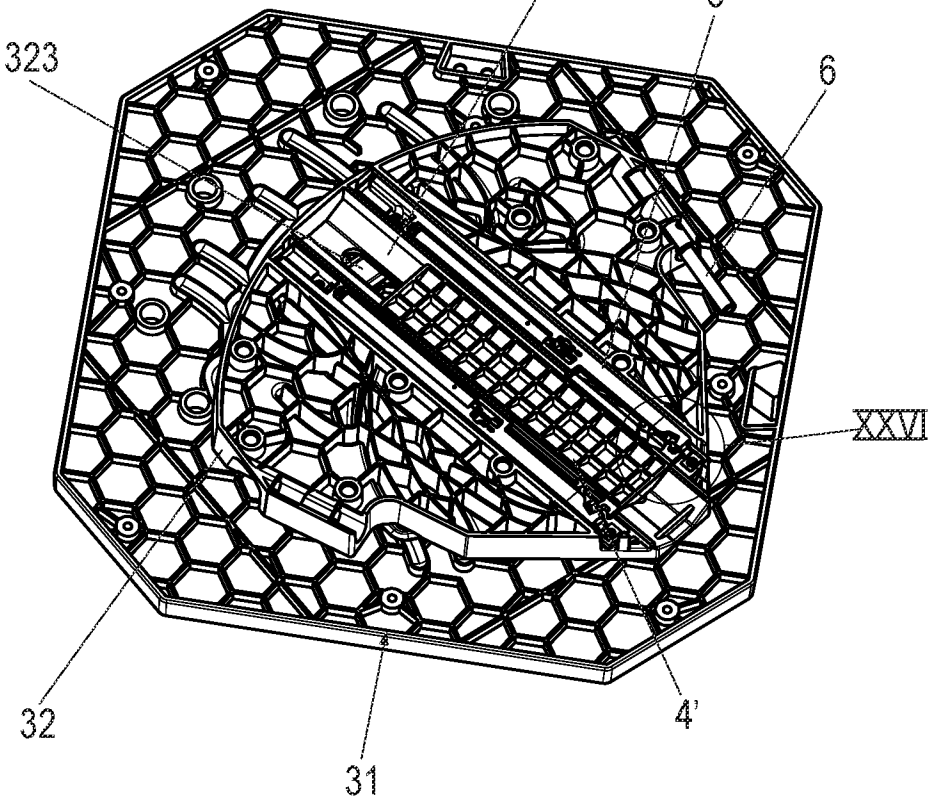
Figure 27:
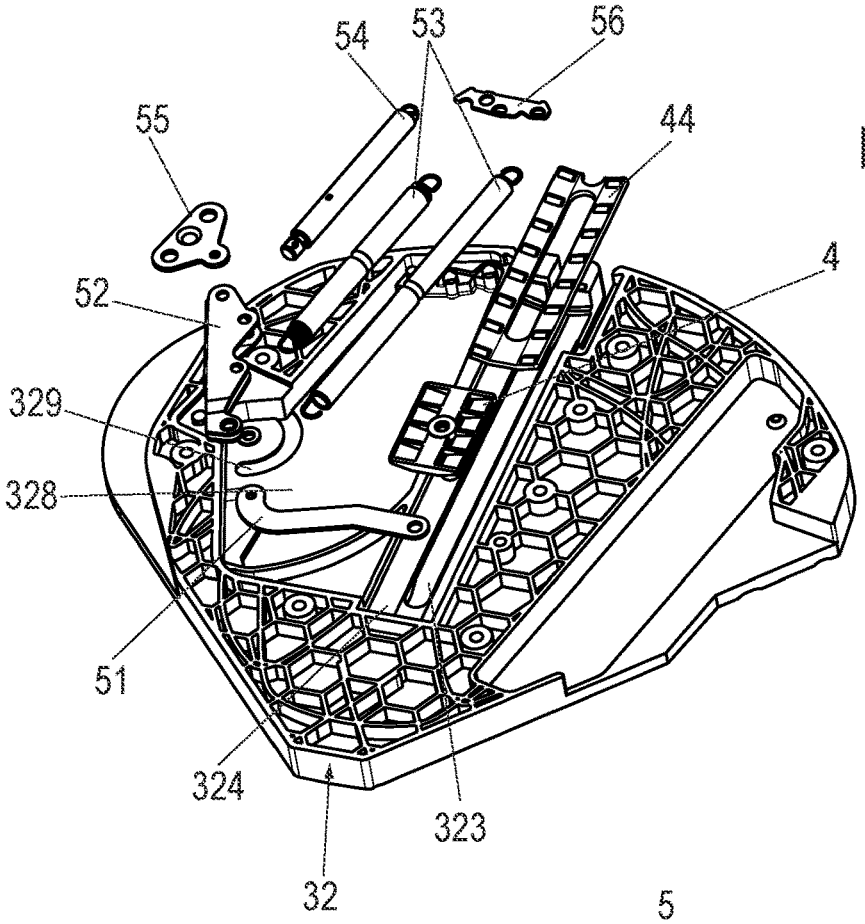
Figure 28:
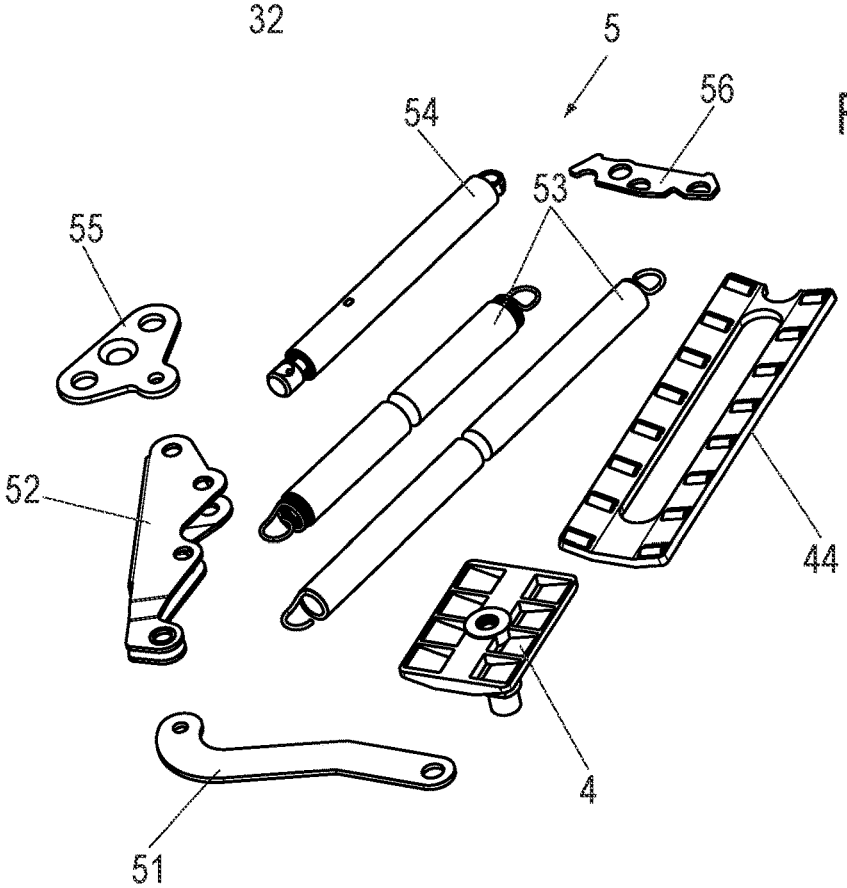
Figure 29:
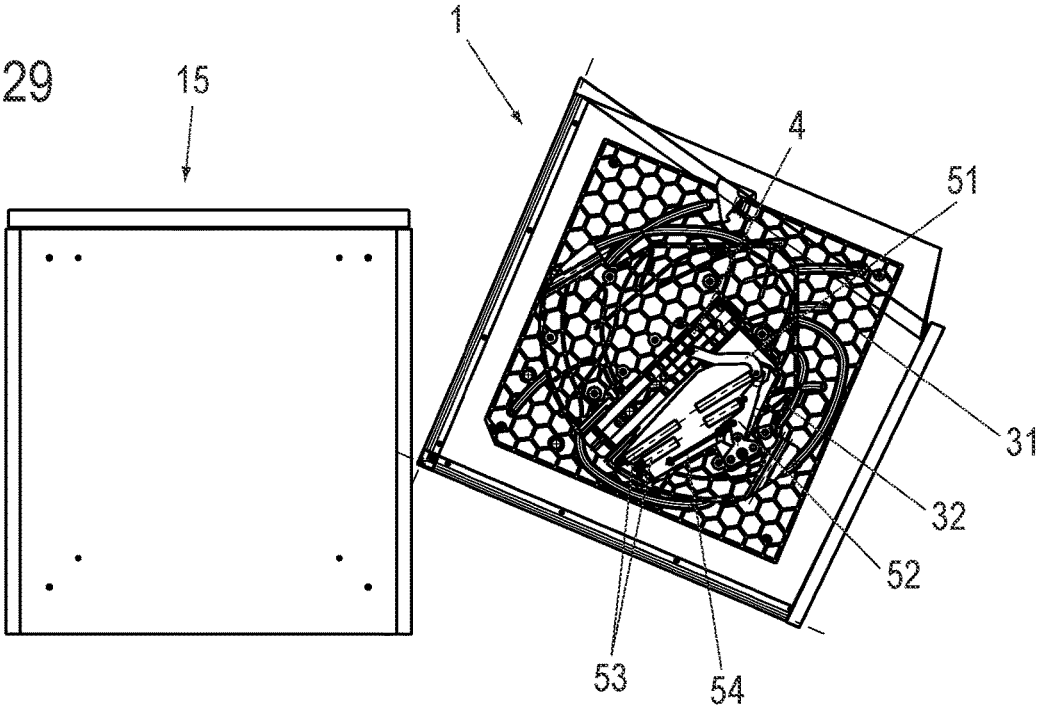
Figure 30:
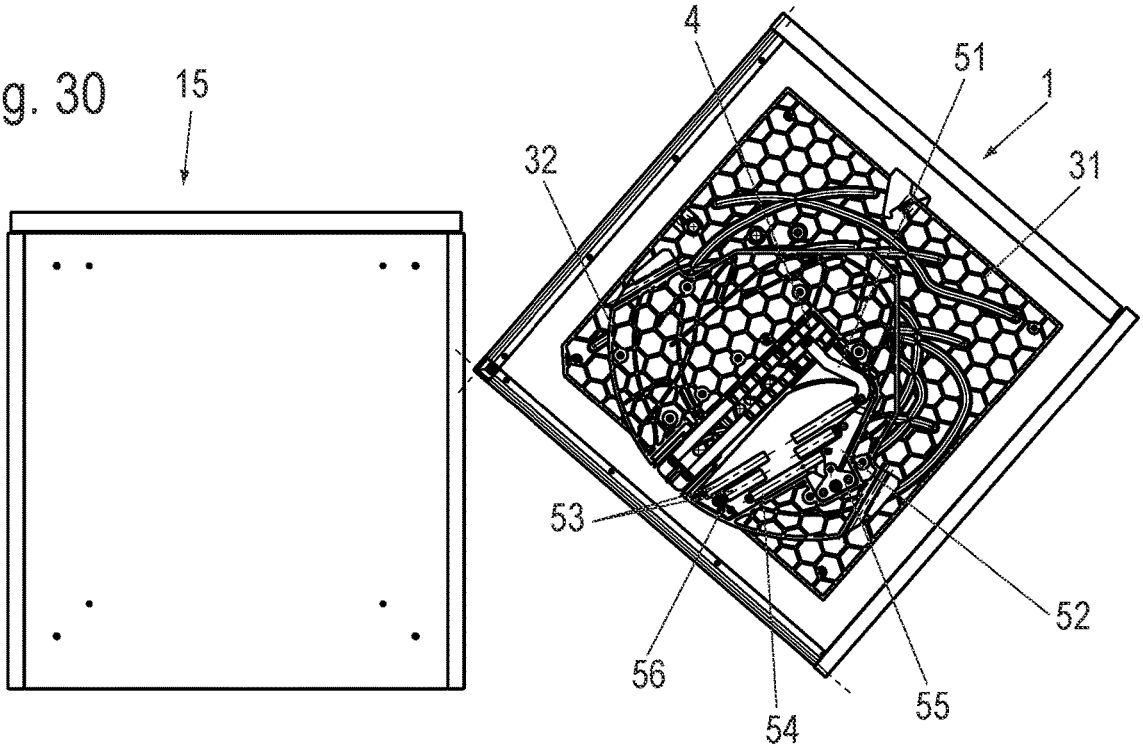
Figure 31:
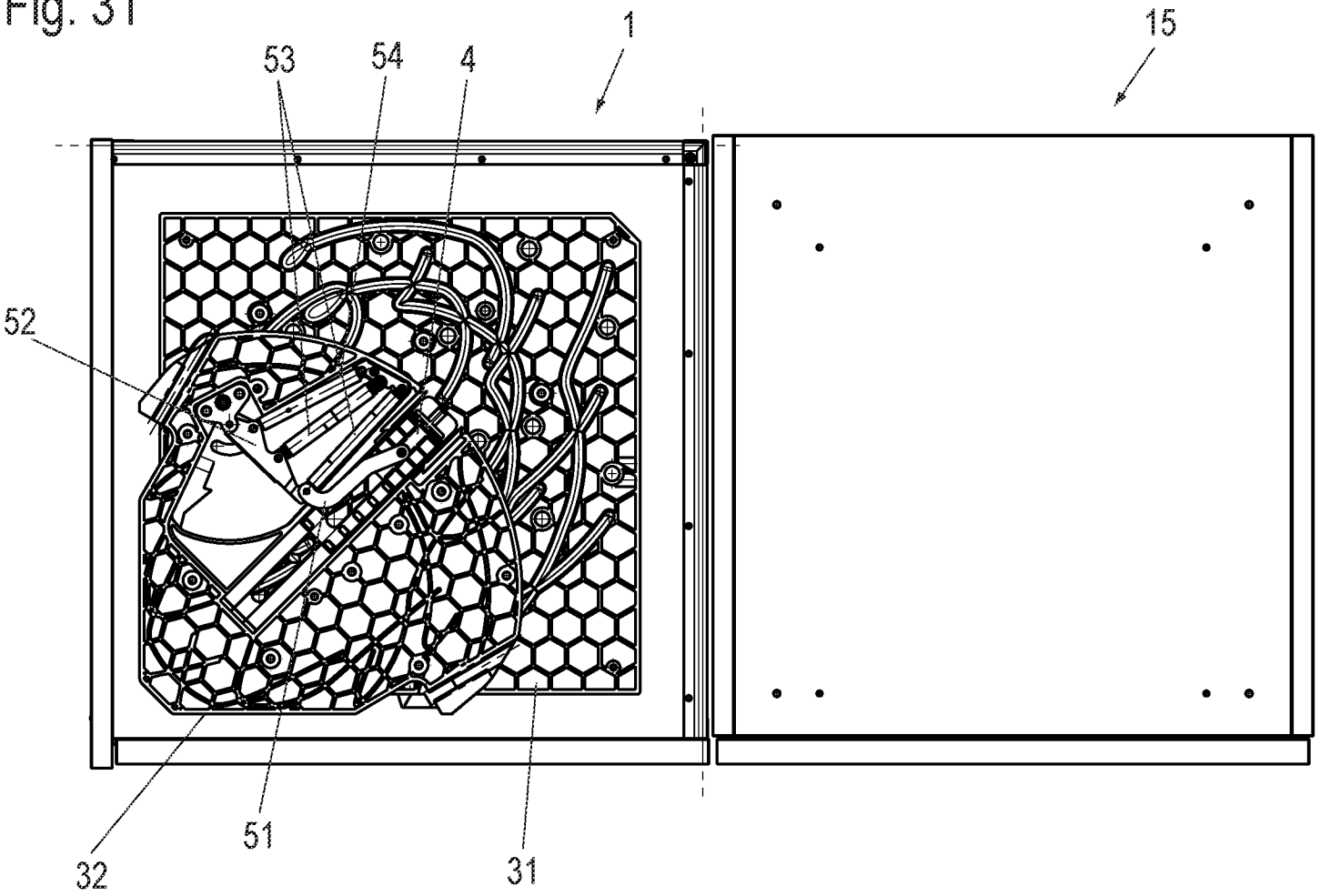
FIG. 31 shows the furniture element 1 in the starting position (closed position), in which the toggle lever is completely relieved.
Figure 32:
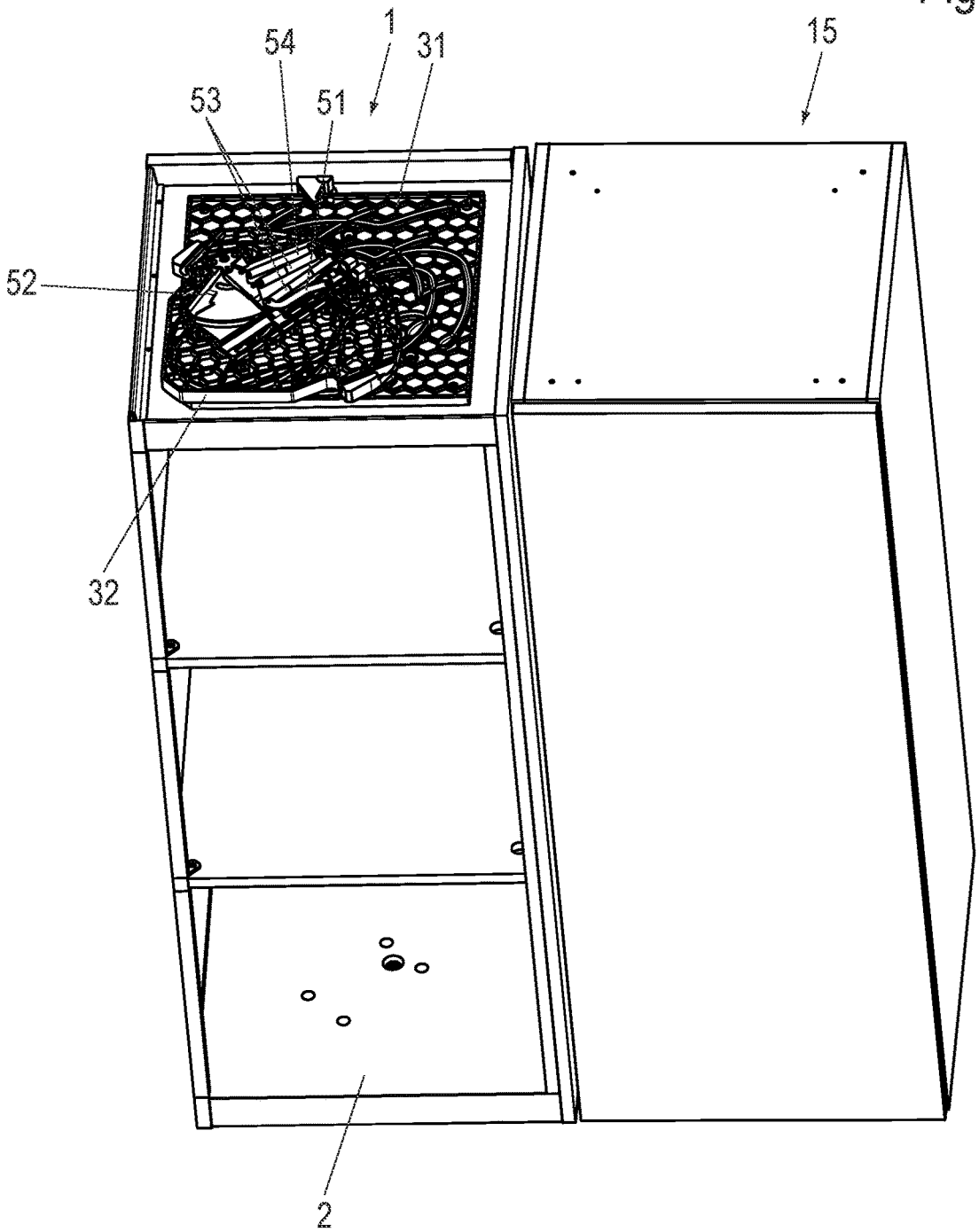
FIG. 32 shows the furniture element 1 in the open position, with the toggle lever of the self-retraction apparatus 5 also relieved.

1 Furniture element
2 Carcass
21 Side wall
22 Side wall
23 Interior space
24 Support surface
25 Frame
3 Translational-rotational fitting
31 Bearing plate
311 Receptacle
32 Carrier plate
321 First side
322 Second side
323 Guide channel
324 Carriage track
325 Rolling element bearing plane
326 Receptacle
327 Slider
328 Power lever receptacle
329 Guide groove
33 Rolling element cage
4, 4' Guide carriage
41 Base body
42 Wheel
43 Guide pin
44 Rolling bearing
5 Self-retraction apparatus
51 Pendulum lever
52 Power lever
53 Energy storage device
54 Damper
55 Pivot bearing
56 Fastening bearing
57
6 Opening mechanism
60 Opening mechanism
61 Housing
62 Plunger
7 Coupling element
71, 71' First activator
72 Second activator
74 Web
75 Coupling element
76 Third activator
8 Coupling element
81 Carriage coupling part
82 Running rail coupling part
9 Pull-out guide
91 Guide rail
92 Running rail

10 Rolling element
11 Foot
12 Running groove
13 Activator
14 Rotary bearing
$R_1$, $R_2$ Direction of rotation
A Translation direction
P Area

The invention claimed is:

1. A furniture element (1), in particular a support or shelf having at least one storage level, comprising:

a carcass (2) having at least one support surface (24), a translational-rotational fitting (3) configured for enabling translational-rotational movement of the carcass (2) relative to a carrier plate (32) of the translational-rotational fitting (3) from a starting position to an open position and back, wherein the carcass (2) is movable relative to the carrier plate (32) from the starting position to an intermediate position and further to the open position and back, wherein in the intermediate position the carcass (2) is rotated relative to the carrier plate (32) in a direction of rotation (R1, R2) and displaced in a predetermined direction (A), wherein a guide channel (323) specifying the predetermined direction (A) is provided in the carrier plate (32), in which a guide carriage (4, 4') is displaceably accommodated, and further comprising at least one self-retraction apparatus (5) which is coupled at least in sections to the guide carriage (4, 4') and arranged indirectly or directly on a side (322) of the carrier plate (32) facing away from the carcass (2), wherein the self-retraction apparatus (5) is attached directly to the side (322) of the carrier plate (32) facing away from the carcass (2), wherein a coupling element (7) having at least one first activator (71) configured for activating the self-retraction apparatus (5) is arranged on the guide carriage (4), wherein the coupling element (7) is designed as a bracket which is integrally formed on or attached to the guide carriage (4), and wherein the at least one first activator (71) protrudes from a web (74) of the coupling element (7), which web projects laterally beyond the guide carriage (4).

2. The furniture element (1) according to claim 1, wherein the at least one first activator (71') configured for activating the self-retraction apparatus (5) is integrally formed on the guide carriage (4').

3. The furniture element (1) according to claim 1, wherein one said self-retraction apparatus (5) coupled to the guide carriage (4) is arranged on either side of the guide carriage (4) on a side (322) of the carrier plate (32) facing away from the carcass (2).

4. The furniture element (1) according to claim 1, further comprising at least one opening mechanism (6, 60), which is coupled at least in sections to the guide carriage (4) and arranged on the side (322) of the carrier plate (32) facing away from the carcass, for opening the carcass (2).

5. The furniture element (1) according to claim 4, wherein a separate coupling element (75) having at least one third activator (76) for activating the at least one opening mechanism (6, 60) is arranged on the guide carriage (4).

6. The furniture element (1) according to claim 4, wherein at least one second activator (72) configured for activating the at least one opening mechanism (6, 60) is arranged on the coupling element (7) with the at least one first activator (71) configured for activating the self-retraction apparatus (5).

7. The furniture element (1) according to claim 4, wherein on both sides of the guide carriage (4) one said opening mechanism (6) coupled to the guide carriage (4) is arranged in each case on the side (322) of the carrier plate (32) facing away from the carcass (2).

8. The furniture element (1) according to claim 4, wherein the self-retraction apparatus (5) is arranged between the guide channel (323) and the at least one opening mechanism (6), as viewed perpendicularly to a longitudinal extension of the guide channel (323).

9. The furniture element (1) according to claim 4, wherein the at least one opening mechanism (60) is designed as an electrical or electromechanical opening mechanism.

10. The furniture element (1) according to claim 4, wherein the at least one opening mechanism (6) is arranged on the at least one pull-out guide (9).

11. The furniture element (1) according to claim 1, further comprising at least one opening mechanism (6) arranged at a distance from the guide channel (323) on or in the carrier plate (32) and being configured for opening the carcass (2), wherein, for activating the opening mechanism (6), a surface of the carcass (2) or of the bearing plate (31) of the translational-rotational fitting (3) or an activator (13) arranged on the carcass (2) or on the bearing plate (31) can be brought into engagement with the opening mechanism (6).

12. The furniture element (1) according to claim 11, wherein the at least one opening mechanism (6) is designed as a mechanical opening mechanism having a plunger (62) spring-mounted in a housing (61) or as an electromotively driven opening mechanism having a plunger (62) mounted in a housing (61) and drivable by an electric motor.

13. The furniture element (1) according to claim 1, wherein the at least one self-retraction apparatus (5) has a damper.

14. A piece of furniture having at least one furniture element (1) rotatably mounted in a furniture carcass, wherein the furniture element (1) is designed according to claim 1.

15. A furniture element (1), in particular a support or shelf having at least one storage level, comprising:

a carcass (2) having at least one support surface (24), a translational-rotational fitting (3) configured for enabling translational-rotational movement of the carcass (2) relative to a carrier plate (32) of the translational-rotational fitting (3) from a starting position to an open position and back, wherein the carcass (2) is movable relative to the carrier plate (32) from the starting position to an intermediate position and further to the open position and back, wherein in the intermediate position the carcass (2) is rotated relative to the carrier plate (32) in a direction of rotation (R1, R2) and displaced in a predetermined direction (A), wherein a guide channel (323) specifying the predetermined direction (A) is provided in the carrier plate (32), in which a guide carriage (4, 4') is displaceably accommodated, and further comprising at least one self-retraction apparatus (5) which is coupled at least in sections to the guide carriage (4, 4') and arranged indirectly or directly on a side (322) of the carrier plate (32) facing away from the carcass (2), wherein the guide carriage (4) is coupled to a running rail (92) of at least one pull-out guide (9), wherein a guide rail (91) of the pull-out guide (9) is fastened to the side (322) of the carrier plate (32) facing away from the carcass (2), wherein the at least one self-retraction apparatus (5) is arranged on the guide rail (91), and wherein the at least one pull-out guide (9) is coupled via a coupling element (8) integrally formed on or attached to the guide carriage (4).

16. A furniture element (1), in particular a support or shelf having at least one storage level, comprising:

a carcass (2) having at least one support surface (24), a translational-rotational fitting (3) configured for enabling translational-rotational movement of the carcass (2) relative to a carrier plate (32) of the translational-rotational fitting (3) from a starting position to an open position and back, wherein the carcass (2) is movable relative to the carrier plate (32) from the starting position to an intermediate position and further to the open position and back, wherein in the intermediate position the carcass (2) is rotated relative to the carrier plate (32) in a direction of rotation (R1, R2) and displaced in a predetermined direction (A), wherein a guide channel (323) specifying the predetermined direction (A) is provided in the carrier plate (32), in which a guide carriage (4, 4') is displaceably accommodated, and further comprising at least one self-retraction apparatus (5) which is coupled at least in sections to the guide carriage (4, 4') and arranged indirectly or directly on a side (322) of the carrier plate (32) facing away from the carcass (2), wherein the at least one self-retraction apparatus (5) has a toggle lever with a pendulum lever (51) pivotably attached to the guide carriage (4) and a power lever (52) pivotably coupled to the pendulum lever (51) and pivotably attached to the carrier plate (32), wherein at least one energy storage device (53) held on the carrier plate (32) is arranged on the power lever (52) or the pendulum lever (51).

* * * * *